US006693062B2

(12) United States Patent
Dooms et al.

(10) Patent No.: US 6,693,062 B2
(45) Date of Patent: Feb. 17, 2004

(54) THERMOGRAPHIC RECORDING MATERIAL WITH IMPROVED IMAGE TONE

(75) Inventors: Philip Dooms, Oosteeklo (BE); Ivan Hoogmartens, Wilrijk (BE); Geert Defieuw, Bonheiden (BE)

(73) Assignee: Agfa-Gevaert (BE)

( * ) Notice: Subject to any disclaimer, the term of this patent is extended or adjusted under 35 U.S.C. 154(b) by 78 days.

(21) Appl. No.: 10/183,261

(22) Filed: Jun. 27, 2002

(65) Prior Publication Data

US 2003/0186809 A1 Oct. 2, 2003

Related U.S. Application Data

(60) Provisional application No. 60/307,464, filed on Jul. 24, 2001.

(30) Foreign Application Priority Data

Jun. 29, 2001 (EP) ..... 01000259

(51) Int. Cl.[7] ..... B41M 5/28
(52) U.S. Cl. ..... 503/201; 503/212
(58) Field of Search ..... 503/201, 212

(56) References Cited

FOREIGN PATENT DOCUMENTS

EP 0 692 733 A2 1/1996

EP 0 903 625 A1 3/1999

OTHER PUBLICATIONS

Search Report for EP 01 00 0259, Dec. 11, 2001.

*Primary Examiner*—B. Hamilton Hess
(74) *Attorney, Agent, or Firm*—Leydig, Voit & Mayer, Ltd.

(57) ABSTRACT

A monosheet black and white substantially light-insensitive thermographic recording material comprising a thermosensitive element and a support, the thermosensitive element containing one or more substantially light-insensitive organic silver salts, one or more reducing agents consisting of one or more 1,2-dihydroxybenzene-compounds in thermal working relationship therewith and a binder, wherein the molar ratio of molar hydroxy-equivalents of the 1,2-dihydroxybenzene compounds to molar silver-equivalents of the substantially light-insensitive organic silver salts is between 1.2 and 6.0; the 1,2-dihydroxybenzene-compounds have a —(CH=CH)$_n$R group in the 4 position wherein n is zero or an integer and R is a substituent with a Hammett $\sigma_p$ constant >0.35 and <0.95 exclusive of a carboxy-group; and the benzene ring of the 1,2-dihydroxy-compounds is optionally further substituted with an entity selected from the group consisting of an alkyl, substituted alkyl, alkenyl, aryl, heteroaryl, alkoxy, thioalkyl, aryloxy, thioaryl, thioheteroaryl, acyloxy, thioacyl, amido, sulphonamido and halogen groups, an annelated aryl ring system and an annelated heteroaryl ring system; and a thermographic recording process therefor.

28 Claims, No Drawings

THERMOGRAPHIC RECORDING MATERIAL WITH IMPROVED IMAGE TONE

The application claims the benefit of U.S. Provisional Application No. 60/307,464 filed Jul. 24, 2001, which is herein incorporated by reference.

FIELD OF THE INVENTION

The present invention relates to thermographic recording materials whose prints have improved image tone.

BACKGROUND OF THE INVENTION

Thermal imaging or thermography is a recording process wherein images are generated by the use of thermal energy. In direct thermal thermography a visible image pattern is formed by image-wise heating of a recording material.

EP 692 733 discloses a direct thermal recording process wherein a direct thermal recording material is heated dot-wise and the direct thermal recording material comprises on a substrate an imaging layer containing uniformly distributed in a film-forming polymeric binder (i) one or more substantially light-insensitive organic silver salts being no double salts, the silver salt(s) being in thermal working relationship with (ii) an organic reducing agent therefor, wherein the reducing agent is a benzene compound the benzene nucleus of which is substituted by no more than two hydroxy groups which are present in 3,4-position on the nucleus and have in the 1-position of the nucleus a substituent linked to the nucleus by means of a carbonyl group.

EP-A 903 625 discloses a substantially light-insensitive black and white monosheet thermographic recording material is provided comprising a support and a thermosensitive element containing a substantially light-insensitive organic silver salt, a 1,2-dihydroxybenzene-compound in thermal working relationship therewith and a binder, characterized in that the 1,2-dihydroxybenzene-compound is represented by formula (I):

(I)

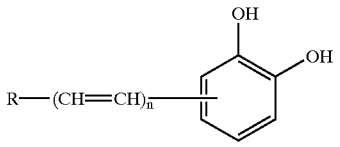

where R is $—P(=O)R^1R^2$, $—SO_xR^3$, —CN, $—NO_2$ or $—CR^4=NR^5$ when n is 0; R is $—P(=O)R^1R^2$, $—SO_xR^3$, —CN, $—NO_2$, $—CR^4=NR^5$ or $—COR^6$ when n is an integer; $R^1$ and $R^2$ are independently an alkyl, a substituted alkyl, an aryl, a substituted aryl group, an alkoxy, a substituted alkoxy, an aryloxy, a substituted aryloxy, a hydroxy group, an amino group or a substituted amino group; $R^3$ is an alkyl, a substituted alkyl, an aryl, a substituted aryl, an amino or a substituted amino group; $R^4$ is an alkyl, a substituted alkyl, an aryl or a substituted aryl group or hydrogen; $R^5$ is an alkyl, a substituted alkyl, an aryl, a substituted aryl, a hydroxy, an alkoxy, an aryloxy, an acyl, an amino or a substituted amino group; $R^6$ is an alkyl, a substituted alkyl, an aryl, a substituted aryl, an alkoxy, a substituted alkoxy, an aryloxy, a substituted aryloxy, a hydroxy, an amino or a substituted amino group or hydrogen; x is 1, 2 or 3; and the benzene ring of the 1,2-dihydroxybenzene-compound represented by the formula (I) may be further substituted.

Unpublished European Patent Application Nr. EP01000096.6 disclosed a monosheet black and white substantially light-insensitive thermographic recording material comprising a thermosensitive element and a support, the thermosensitive element containing a substantially light-insensitive organic silver salt, a 3,4-dihydroxybenzene compound in thermal working relationship therewith and a binder, characterized in that the 3,4-dihydroxybenzene compound is an aryloxo-3,4-dihydroxybenzene compound in which the aryl-group is substituted with at least one substituent having a $\sigma_m$-value greater than 0; or a heteroaryloxo-3,4-dihydroxybenzene compound in which the heteroaryl group has a unified aromaticity index $I_A$ greater than 53 and is optionally substituted with at least one group selected from the group consisting of aryl, hydroxy, carboxy, sulfo, sulfoalkyl, sulfoaryl, sulfonylalkyl, sulfonylaryl, annulated aryl, annulated heteroaryl, carboxyalkyl, carboxyaryl, oxoalkyl, oxoaryl, halogen, nitro, cyano and mercapto-alkyl groups; and a thermographic recording process therefor.

Unpublished European Patent Application Nr. EP01000095.8 disclosed a monosheet black and white substantially light-insensitive thermographic recording material comprising a thermosensitive element and a support, the thermosensitive element containing a substantially light-insensitive organic silver salt, a 1,2-dihydroxybenzene-compound in thermal working relationship therewith and a binder, characterized in that the 1,2-dihydroxybenzene-compound is represented by formula (I): $R^1SO_2R^2$, wherein $R^1$ is an optionally substituted aryl group and $R^2$ is selected from the group consisting of a 3,4,5-trihydroxyphenyl group, a 3-alkoxy-4,5-dihydroxyphenyl group and a 3-aryloxy-4,5-dihydroxyphenyl group; or the 1,2-dihydroxybenzene-compound is represented by formula (II): $R^3COOR^4$, wherein $R^3$ is a 3-alkoxy-4,5-dihydroxyphenyl group or a 3-aryloxy-4,5-dihydroxyphenyl group; and $R^4$ is an alkyl group or an aryl group; and a thermographic recording process therefor.

U.S. Pat. No. 3,028,254 discloses heat-sensitive copy-sheets comprising a substantially light-insensitive organic silver salt, a reducing agent therefor and a binder. Specifically in Example 1 molar ratio of molar hydroxy-equivalents of reducing agents to molar silver-equivalents of the substantially light-insensitive organic silver salts of 1.78 and 1.33 are disclosed with respect to 3,3,3',3'-tetramethyl-1,1'-spiro-bis-indane 5,5',6,6'-tetrol and behenyl pyrogallol and silver behenate; and 3,3,3',3'-tetramethyl-1,1'-spiro-bis-indane 5,5',6,6'-tetrol and silver behenate respectively.

U.S. Pat. No. 3,031,329 discloses heat-sensitive copy-sheets comprising a substantially light-insensitive organic silver salt, a reducing agent therefor and a binder. Specifically in Examples 1 and 2 molar ratios of molar hydroxy-equivalents of reducing agents to molar silver-equivalents of the substantially light-insensitive organic silver salts of 7.29 and 4.13 are disclosed respectively with respect to 3,3,3',3'-tetramethyl-1,1'-spiro-bis-indane 5,5',6,6'-tetrol, 3,4-dihydroxybenzoic acid and silver behenate; and methyl gallate and silver behenate respectively.

U.S. Pat. No. 3,074,809 discloses heat-sensitive copy-sheets comprising a substantially light-insensitive organic silver salt, a reducing agent therefor and a binder. Specifically in Examples 1, 2 and 3 molar ratios of molar hydroxy-equivalents of reducing agents to molar silver-equivalents of the substantially light-insensitive organic silver salts of 5.725, 5.725 and 2.310 are disclosed respectively with respect to hydroquinone and silver behenate; hydroquinone and silver behenate; and methyl gallate, 2,3-dihydroxybenzoic acid and silver behenate respectively.

U.S. Pat. No. 3,103,881 discloses heat-sensitive copy-sheets comprising a substantially light-insensitive organic silver salt, a reducing agent therefor and a binder. Specifically in Example 3 a molar ratio of molar hydroxy-equivalents of reducing agents to molar silver-equivalents of the substantially light-insensitive organic silver salts of 2.95 is disclosed with respect to 3,4-dihydroxy-benzoic acid and silver behenate.

U.S. Pat. No. 3,107,174 discloses heat-sensitive copy-sheets comprising a substantially light-insensitive organic silver salt, a reducing agent therefor and a binder. Specifically in Example 1 a molar ratio of molar hydroxy-equivalents of reducing agents to molar silver-equivalents of the substantially light-insensitive organic silver salts of 3.29 is disclosed with respect to methyl gallate and silver behenate.

Typical X-ray images with conventional silver halide radiographic film have an image tone corresponding to CIELAB-values of $a^*=-4.62$ and $b^*=-8.86$ for D=1.0 and $a^*=-2.53$ and $b^*=-4.41$ for a density of 2.0 and exhibit excellent archivability both as regards stability of image density and stability of image tone. Prints produced with prior art thermographic recording materials which exhibit acceptable archivability exhibit a reddish image tone and prior art thermographic recording materials which exhibit clinically acceptable neutral ($a^*=b^*=0$) to bluish image tone ($a^*=0$ to $-7$; $b^*<0$) exhibit unacceptable archivability. This problem is particularly acute if prints are produced with thermal head printers with a heating time ≦15 ms. It is desirable to obtain image tones as close to the image tone typically attained with silver halide radiographic film as possible.

ASPECTS OF THE INVENTION

It is therefore an aspect of the present invention to provide concepts to enable substantially light-insensitive thermographic recording materials to be developed whose prints exhibit both satisfactory archivability and image tone.

It is a further aspect of the present invention to provide concepts to enable substantially light-insensitive thermographic recording materials to be developed which upon printing with a thermal head printer with a heating time ≦15 ms produce prints exhibiting both satisfactory archivability and image tone.

Further aspects and advantages of the invention will become apparent from the description hereinafter.

SUMMARY OF THE INVENTION

It has been surprisingly found that with particular classes of 1,2-dihydroxybenzene compound reducing agents, an increase in the molar ratio of molar equivalents of active hydroxy groups in the 1,2-dihydroxybenzene compound reducing agent or mixtures thereof with respect to the molar equivalents of organic silver salt or mixtures thereof above the stoichiometric value of 1.00 had the unexpected result of reducing both the CIELAB a*-value of prints produced therewith without the expected prohibitive deterioration in the archival properties of the prints. This effect was found to be particularly pronounced when the prints were produced with a thermal head printer with heating time ≦15 ms.

The above mentioned aspects of the present invention are realized by providing a monosheet black and white substantially light-insensitive thermographic recording material comprising a thermosensitive element and a support, the thermosensitive element containing one or more substantially light-insensitive organic silver salts, one or more reducing agents consisting of one or more 1,2-dihydroxybenzene-compounds in thermal working relationship therewith and a binder, wherein the molar ratio of molar hydroxy-equivalents of the 1,2-dihydroxybenzene compounds to molar silver-equivalents of the substantially light-insensitive organic silver salts is between 1.2 and 6.0; the 1,2-dihydroxybenzene-compounds have a $-(CH{=}CH)_nR$ group in the 4 position wherein n is zero or an integer and R is a substituent with a Hammett $\sigma_p$ constant >0.35 and <0.95 exclusive of a carboxy-group; and the benzene ring of the 1,2-dihydroxy-compounds is optionally further substituted with an entity selected from the group consisting of an alkyl, substituted alkyl, alkenyl, aryl, heteroaryl, alkoxy, thioalkyl, aryloxy, thioaryl, thioheteroaryl, acyloxy, thioacyl, amido, sulphonamido and halogen groups, an annelated aryl ring system and an annelated heteroaryl ring system.

The above mentioned aspects of the present invention are also realized by providing a thermographic recording process for the monosheet black and white substantially light-insensitive thermographic recording material described herein comprising the steps of: (i) providing the thermographic recording material; (ii) bringing the thermographic recording material into the proximity of a heat source; (iii) applying heat imagewise from the heat source to the thermographic recording material; and (iv) removing the thermographic recording material from the proximity of the heat source.

Several embodiments are disclosed in the dependent claims.

DETAILED DESCRIPTION OF THE INVENTION

According to a first embodiment of the thermographic recording process, according to the present invention, the heat source is a thermal head. According to a second embodiment of the thermographic recording process according to the present invention, the heat source is a thin film thermal head. According to a third embodiment of the thermographic recording material according to the present invention, the heat source is a thin film thermal head operating with heating time of ≦25 ms. According to a fourth embodiment of the thermographic recording material according to the present invention, the heat source is a thin film thermal head operating with heating time of ≦15 ms.

Definitions

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl etc.

"Annelated" means having a carbon—carbon bond in common with e.g. annelation of a benzene ring with a naphthalene ring results in anthracene or phenanthrene depending on which carbon—carbon bond in the naphthalene ring is common to both the naphthalene ring and the benzene ring.

By substantially light-insensitive is meant not intentionally light sensitive.

Selected values of Hammett $\sigma_m$ and Hammett $\sigma_p$ substituent constants are to be found in Advances in Linear Free Energy Relationships, Edited by N. B. Chapman and J. Shorter, published by Plenum Press, London in 1972 on pages 28–29. The highest value reported for the Hammett $\sigma_m$ and Hammett $\sigma_p$ substituent constants is regarded as being the Hammett $\sigma_m$ and Hammett $\sigma_p$ substituent constant for the purposes of the present invention.

The unified aromaticity index $I_A$ is described by C. W. Bird in Tetrahedron, 48(32), 335–340 (1992), which also discloses aromaticity index values for a large range of aromatic groups.

The molar hydroxy-equivalents of a 1,2-dihydroxybenzene compound is obtained by multiplying the molar concentration of the 1,2-dihydroxybenzene compound by the number of hydroxy-groups substituents on benzene rings in formula (I) and then adding these values together. For example ethyl 3,4-dihydroxybenzoate has two molar hydroxy-equivalents per mole, n-propyl gallate with the benzene ring substituted with three hydroxy-groups has three molar hydroxy-equivalents per mole and 3,3,3',3'-tetramethyl-1,1'-spiro-bis-indane 5,5',6,6'-tetrol with two benzene rings each substituted with two hydroxy-groups has four molar hydroxy-equivalents per mole.

The molar silver-equivalent of a substantially light-insensitive organic silver salt is obtained by multiplying the molar concentration of the substantially light-insensitive organic silver salt by the number of silver-atoms in the particular substantially light-insensitive organic silver salt e.g. silver behenate has one molar silver-equivalent per mole and silver adipate, being a silver salt of a dicarboxylic acid, has two molar silver-equivalents per mole.

The molar ratio of the molar hydroxy-equivalent of the 1,2-dihydroxybenzene compound to the molar silver-equivalent of the substantially light-insensitive organic silver salt is obtained by dividing the molar hydroxy-equivalent of the 1,2-dihydroxybenzene compound, obtained as described above, by the molar silver-equivalents of the substantially light-insensitive organic silver salt, obtained as described above.

If more than one 1,2-dihydroxybenzene compound and/or more than one substantially light-insensitive organic silver salt is present, the molar ratio of molar hydroxy-equivalents of the 1,2-dihydroxybenzene compounds to molar silver-equivalents of the substantially light-insensitive organic silver salts is determined by dividing the sum of the hydroxy-equivalents of the 1,2-dihydroxybenzene compounds present by the sum of the silver-equivalents of the substantially light-insensitive organic silver salts present.

The total line time of a thermal head is the time between the beginning of the printing of one line of pixels and the beginning of the printing of the next line of pixels in the printer transport direction. The total line time is equal to the active line time if no cooling time is included in the total line time. Should a cooling time be included in total line time, this cooling time should be subtracted from the total line time to obtain the active line time.

The heating time of a thermal head is obtained by multiplying the active line time of the thermal head by the ratio of the length of the resistance elements in the thermal head in the transport direction of the printer to the distance between the beginning of one printing line to the next printing line e.g. for an active line time of 12 ms, a resistance element length in the printer transport direction of 75 $\mu$m and a distance between the beginning of one printing line to the next printing line of 50 $\mu$m, the printing time is $12\times(75/50)=18$ ms. This heating time corresponds to the time during which the film element experiences heat.

Heating in association with the expression a substantially water-free condition as used herein, means heating at a temperature of 80 to 250° C. The term "substantially water-free condition" as used herein means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Molar Ratio of Molar OH-equivalents of the 1,2-dihydroxybenzene Compounds to Molar Ag-equivalents of the Organic Silver Salts According to a first embodiment of the substantially light-insensitive thermographic recording material of the present invention the molar ratio of molar hydroxy-equivalents of the 1,2-dihydroxybenzene compounds to molar silver-equivalents of the substantially light-insensitive organic silver salts is 1.3 to 5.0.

According to a second embodiment of the substantially light-insensitive thermographic recording material of the present invention the molar ratio of molar hydroxy-equivalents of the 1,2-dihydroxybenzene compounds to molar silver-equivalents of the substantially light-insensitive organic silver salts is 1.3 to 4.0.

According to a third embodiment of the substantially light-insensitive thermographic recording material of the present invention the molar ratio of molar hydroxy-equivalents of the 1,2-dihydroxybenzene compounds to molar silver-equivalents of the substantially light-insensitive organic silver salts is 1.5 to 3.5.

According to a fourth embodiment of the substantially light-insensitive thermographic recording material of the present invention the molar ratio of molar hydroxy-equivalents of the 1,2-dihydroxybenzene compounds to molar silver-equivalents of the substantially light-insensitive organic silver salts is 1.5 to 3.0.

According to a fifth embodiment of the substantially light-insensitive thermographic recording material of the present invention the molar ratio of molar hydroxy-equivalents of the 1,2-dihydroxybenzene compounds to molar silver-equivalents of the substantially light-insensitive organic silver salts is 1.5 to 2.5.

According to a sixth embodiment of the substantially light-insensitive thermographic recording material of the present invention the molar ratio of molar hydroxy-equivalents of the 1,2-dihydroxybenzene compounds to molar silver-equivalents of the substantially light-insensitive organic silver salts is 1.3 to 2.0.

1,2-dihydroxybenzene Compounds According to Formula (I)

The 1;2-dihydroxybenzene-compounds used the substantially light-insensitive thermographic recording material of the present invention have a $—(CH{=}CH)_nR$ group in the 4 position wherein n is zero or an integer and R is a substituent with a Hammett $\sigma_p$ constant >0.35 and <0.95 exclusive of a carboxy-group; and the benzene ring of the 1,2-dihydroxy-compounds is optionally further substituted with an entity selected from the group consisting of an alkyl, substituted alkyl, alkenyl, aryl, heteroaryl, alkoxy, thioalkyl, aryloxy, thioaryl, thioheteroaryl, acyloxy, thioacyl, amido, sulphonamido and halogen groups, an annelated aryl ring system and an annelated heteroaryl ring system.

According to an seventh embodiment of the substantially light-insensitive thermographic recording material of the present invention the R group in the 1,2-dihydroxybenzene-compounds is $—P({=}O)R^1R^2$, $—SO_xR^3$, —CN, $—NO_2$, —CR═NR$^5$ or —COR$^6$; R$^1$ and R$^2$ are independently an alkyl, a substituted alkyl, an aryl, a substituted aryl group, an alkoxy, a substituted alkoxy, an aryloxy, a substituted aryloxy, a hydroxy group, an amino group or a substituted amino group; R$^3$ is an alkyl, a substituted alkyl, an aryl, a substituted aryl, an amino or a substituted amino group; R$^4$ is an alkyl, a substituted alkyl, an aryl or a substituted aryl group or hydrogen; R$^5$ is an alkyl, a substituted alkyl, an aryl, a substituted aryl, a hydroxy, an alkoxy, an aryloxy, an acyl, an amino or a substituted amino group; R$^6$ is a hydrogen atom or an alkyl, a substituted alkyl, an aryl, an aryl substituted with at least one substituent having a Hammett $\sigma_m$-constant >0 and <0.85, an alkoxy, a substituted alkoxy, an aryloxy, a substituted aryloxy, a heteroaryl having a unified aromaticity index greater than 53 or a substituted heteroaryl group having a unified aromaticity index greater than 53; and x is 1, 2 or 3.

According to an eighth embodiment of the substantially light-insensitive thermographic recording material of the present invention the 1,2-dihydroxybenzene-compounds are selected from the group consisting of 3,4-dihydroxybenzoate alkyl and aryl esters, 3,4-dihydroxybenzophenone, 3,4-dihydroxybenzophenone compounds in which the benzene ring without hydroxy-group substituents is substituted with at least one substituent having a Hammett $\sigma_m$-constant >0 and <0.85, 3,4-dihydroxy-acetophenone and 3,4-dihydroxybenzonitrile.

According to a ninth embodiment of the substantially light-insensitive thermographic recording material of the present invention, the 1,2 dihydroxybenzene compounds according to formula (I) are selected from the reducing agents disclosed in EP-B 692 733, EP-A 903 625 and unpublished European Patent Application Nr. EP01000096.6.

According to a tenth embodiment of the substantially light-insensitive thermographic recording material of the present invention, wherein the thermosensitive element contains more than one of the 1,2-dihydroxybenzene compounds according to formula (I) and one of the 1,2-dihydroxybenzene compounds according to formula (I) is 1,2-dihydroxybenzonitrile.

According to an eleventh embodiment of the substantially light-insensitive thermographic recording material of the present invention, the 1,2-dihydroxybenzene compounds according to formula (I) are 3,4-dihydroxybenzonitrile and 3,4-dihydroxybenzophenone.

According to a twelfth embodiment of the substantially light-insensitive thermographic recording material of the present invention, the 1,2-dihydroxybenzene compounds according to formula (I) is an alkyl 3,4-dihydroxybenzoate such as ethyl 3,4-dihydroxybenzoate and n-butyl 3,4-dihydroxybenzoate.

Suitable 1,2-dihydroxybenzene compounds according to the present invention are:

| | | | $\sigma_p$ of R group | $\sigma_m$ of substituent of phenyl |
|---|---|---|---|---|
| I-1 | 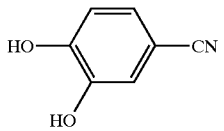 | 3,4-dihydroxybenzonitrile | 0.63; 0.66; 0.69 | — |
| I-2 | 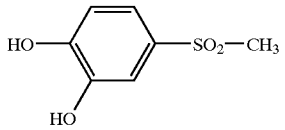 | methyl 3,4-dihydroxyphenyl-sulfphone | 0.73; 0.72; 0.73 | — |
| I-3 | 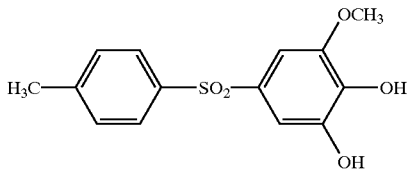 | 4-methyl-3'-methoxy-4',5'-di-hydroxy-diphenyl-sulphone | — | — |
| I-4 | 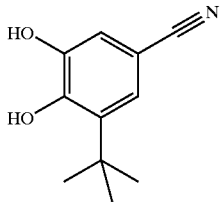 | 3-t-butyl-4,5-dihydroxybenzonitrile | 0.63; 0.66; 0.69 | — |
| I-5 | 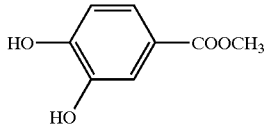 | methyl 3,4-dihydroxybenzoate | 0.52; 0.45; 0.43 | — |

-continued
| | | | $\sigma_p$ of R group | $\sigma_m$ of substituent of phenyl |
|---|---|---|---|---|
| I-6 | 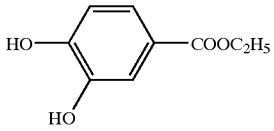 | ethyl 3,4-dihydroxybenzoate | 0.52; 0.45; 0.43 | — |
| I-7 | 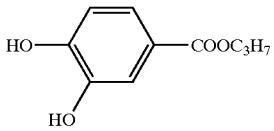 | propyl 3,4-dihydroxybenzoate | 0.52; 0.45; 0.43 | — |
| I-8 | 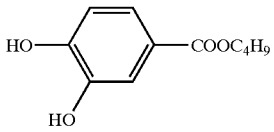 | butyl 3,4-dihydroxybenzoate | 0.52; 0.45; 0.43 | — |
| I-9 | 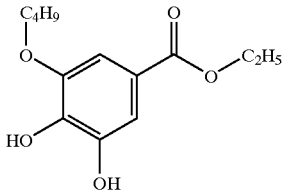 | ethyl 3-n-butoxy-4,5-dihydroxybenzoate | 0.52; 0.45; 0.43 | — |
| I-10 | 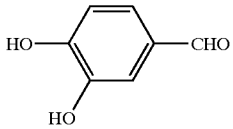 | 3,4-dihydroxybenzaldehyde | 0.43 | — |
| I-11 | 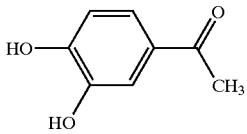 | 3,4-dihydroxyacetophenone | 0.52; 0.50; 0.44 | — |
| I-12 | 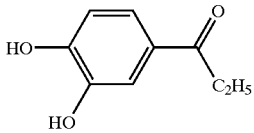 | 3,4-dihydroxybutyrophenone | — | — |
| I-13 | 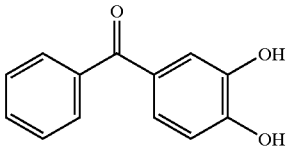 | 3,4-dihydroxybenzophenone | — | — |
| I-14 | 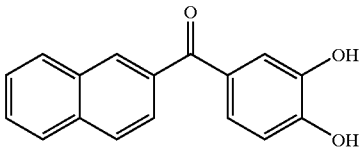 | (3,4-dihydroxyphenyl)-naphthalen-2-yl-methanone | — | — |

-continued
| | | | $\sigma_p$ of R group | $\sigma_m$ of substituent of phenyl |
|---|---|---|---|---|
| I-15 | 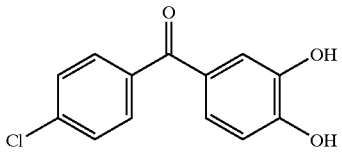 | 3,4-dihydroxy-4'-chloro-benzophenone | — | 0.37; 0.37 |
| I-16 | 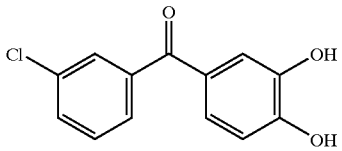 | 3,4-dihydroxy-3'-chloro-benzophenone | — | 0.37; 0.37 |
| I-17 | 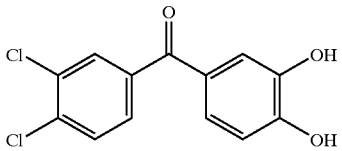 | 3,4-dihydroxy-3',4'-dichloro-benzophenone | — | 0.37; 0.37 |
| I-18 | 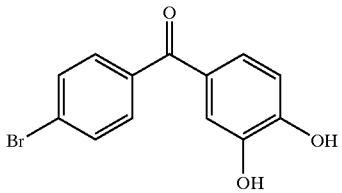 | 3,4-dihydroxy-4'-bromo-benzophenone | — | 0.39; 0.39 |
| I-19 | 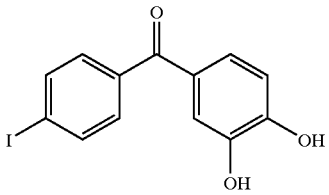 | 3,4-dihydroxy-4'-iodo-benzophenone | — | 0.35; 0.35 |
| I-20 | 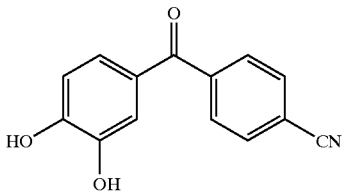 | 3,4-dihydroxy-4'-cyano-benzo-phenone | — | 0.68; 0.56; 0.61 |
| I-21 | 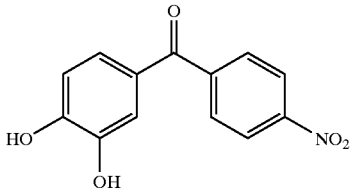 | 3,4-dihydroxy-4'-nitro-benzophenone | — | 0.71; 0.71; 0.70 |
| I-22 | 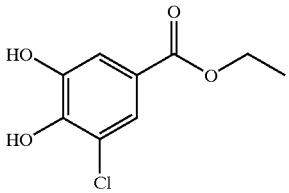 | ethyl 3-chloro-4,5-dihydroxybenzoate | 0.52; 0.45; 0.43 | — |

-continued
| | | | $\sigma_p$ of R group | $\sigma_m$ of substituent of phenyl |
|---|---|---|---|---|
| I-23 | 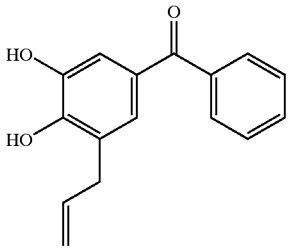 | 3-allyl-4,5-dihydroxybenzophenone | — | — |
| I-24 | 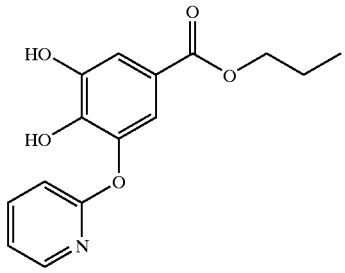 | | 0.52; 0.45; 0.43 | — |
| I-25 | 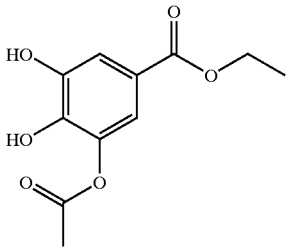 | ethyl 3-oxyacetyl-4,5-dihydroxybenzoate | 0.52; 0.45; 0.43 | — |
| I-26 | 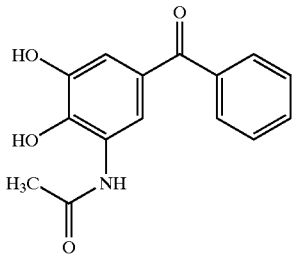 | 3-acetamido-4,5-dihydroxybenzophenone | — | — |
| I-27 | 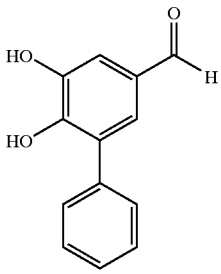 | 3,4-dihydroxy-5-phenyl-benzaldehyde | 0.43 | — |

-continued
| | | | $\sigma_p$ of R group | $\sigma_m$ of substituent of phenyl |
|---|---|---|---|---|
| I-28 | 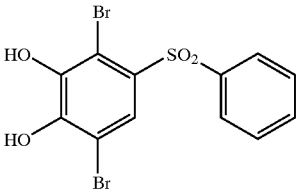 | 2,5-dibromo-3,4-dihydroxydiphenyl-sulphone | — | — |
| I-29 | 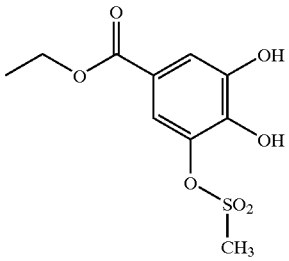 | ethyl 3,4-dihydroxy-5-sulphomethyl-benzoate | 0.52; 0.45; 0.43 | — |
| I-30 | 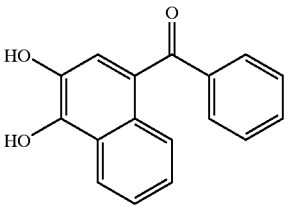 | phenyl-(3,4-dihydroxynaphthalen-1-yl)-methanone | — | — |
| I-31 | 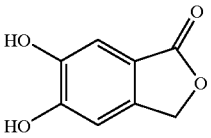 | | — | — |
| I-32 | 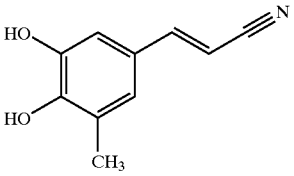 | | — | — |
| I-33 | 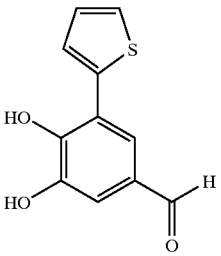 | 3,4-dihydroxy-5-(thien-2-yl)-benzaldehyde | 0.43 | — |

-continued

| | | | $\sigma_p$ of R group | $\sigma_m$ of substituent of phenyl |
|---|---|---|---|---|
| I-34 | 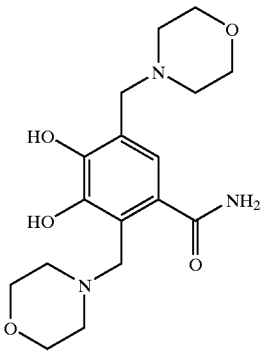 | | 0.38 | — |
| I-35 | 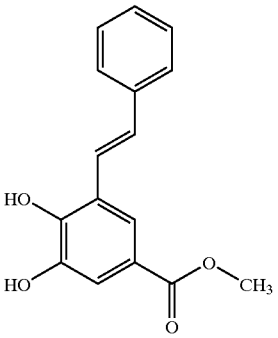 | methyl 3,4-dihydroxy-5-(2-phenyl-ethenyl)-benzoate | 0.52; 0.45; 0.43 | — |
| I-36 | 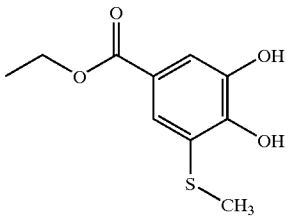 | ethyl 3,4-dihydroxy-5-thiomethyl-benzoate | 0.52; 0.45; 0.43 | — |

Thermosensitive Element

The thermosensitive element as used herein is that element which contains all the ingredients which contribute to image formation. According to the present invention, the thermosensitive element contains one or more substantially light-insensitive organic silver salts, one or more 1,2-dihydroxybenzene-compounds as reducing agents therefor in thermal working relationship therewith and a binder. The element may comprise a layer system in which the above-mentioned ingredients may be dispersed in different layers, with the proviso that the substantially light-insensitive organic silver salts are in reactive association with the reducing agents i.e. during the thermal development process the reducing agent must be present in such a way that it is able to diffuse to the particles of substantially light-insensitive organic silver salt so that reduction to silver can occur.

Organic Silver Salt

According to a thirteenth embodiment of the substantially light-insensitive thermographic recording material of the present invention, the organic silver salts are not double organic salts containing a silver cation associated with a second cation e.g. magnesium or iron ions.

According to a fourteenth embodiment of the substantially light-insensitive thermographic recording material of the present invention, at least one of the organic silver salts is a substantially light-insensitive silver salt of an organic carboxylic acid.

According to a fifteenth embodiment of the substantially light-insensitive thermographic recording material of the present invention, at least one of the organic silver salts is a substantially light-insensitive silver salt of an aliphatic carboxylic acids known as a fatty acid, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention, as disclosed in EP-A 964 300.

Organic silver salts may be dispersed by standard dispersion techniques. Ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and more finely ground dispersions of organic silver salts.

Auxiliary Reducing Agent

Combinations of compounds according to formula (I) with a further reducing agent may also be used that on heating become reactive partners in the reduction of the substantially light-insensitive organic silver salt. According to an sixteenth embodiment of the substantially light-insensitive thermographic recording material of the present invention, the thermosensitive element contains a reducing agent in addition to 1,2-dihydroxybenzene compounds according to formula (I).

According to a seventeenth embodiment of the substantially light-insensitive thermographic recording material of the present invention, the thermosensitive element further contains at least one reducing agent disclosed in unpublished European Patent Application Nr. EP01000095.8, such as: 4-methyl-3',4',5'-trihydroxy-diphenylsulphone.

Binder of the Thermosensitive Element

The film-forming binder of the thermosensitive element may be all kinds of natural, modified natural or synthetic resins or mixtures of such resins, in which the substantially light-insensitive organic silver salt can be dispersed homogeneously either in aqueous or solvent media: e.g. cellulose derivatives such as ethylcellulose, cellulose esters, e.g. cellulose nitrate, carboxymethylcellulose, starch ethers, galactomannan, polymers derived from α, β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

According to an eighteenth embodiment of the substantially light-insensitive thermographic recording material of the present invention, the thermosensitive element contains a binder which does not contain additives or impurities which adversely affect the thermographic properties of the thermographic recording materials in which they are used.

Toning Agent

According to a nineteenth embodiment of the substantially light-insensitive thermographic recording material of the present invention, the thermosensitive element further contains a so-called toning agent organic silver salt in order to obtain a neutral black image tone in the higher densities and neutral grey in the lower densities.

Suitable toning agents are described in U.S. Pat. No. 3,074,809, U.S. Pat. No. 3,446,648 and U.S. Pat. No. 3,844,797 and U.S. Pat. No. 4,082,901. Other particularly useful toning agents are the heterocyclic toning compounds of the benzoxazine dione or naphthoxazine dione type as disclosed in GB 1,439,478, U.S. Pat. No. 3,951,660 and U.S. Pat. No. 5,599,647.

According to a twentieth embodiment of the substantially light-insensitive thermographic recording material of the present invention, the thermosensitive element further contains one or more toning agents selected from the group consisting of phthalazinone, benzo[e][1,3]oxazine-2,4-dione, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

Stabilizers

Stabilizers may be incorporated into the substantially light-insensitive thermographic recording materials of the present invention in order to obtain improved shelf-life and reduced fogging.

According to a twenty-first embodiment of the substantially light-insensitive thermographic recording material of the present invention, the thermosensitive element further contains at least one stabilizer selected from the group consisting of benzotriazole; substituted benzotriazoles; tetrazoles; mercaptotetrazoles, such as 1-phenyl-5-mercaptotetrazole; and aromatic polycarboxylic acids, such as orthophthalic acid, 3-nitro-phthalic acid, tetrachlorophthalic acid, mellitic acid, pyromellitic acid and trimellitic acid, and anhydrides thereof.

Polycarboxylic Acids and Anhydrides Thereof

According to a twenty-second embodiment of the substantially light-insensitive thermographic recording material of the present invention, the thermosensitive element further comprises at least one optionally substituted aliphatic (saturated as well as unsaturated aliphatic and also cycloaliphatic) polycarboxylic acid and/or anhydride thereof in a molar percentage of at least 15 with respect to all the organic silver salt(s) present and in thermal working relationship therewith. The polycarboxylic acid may be used in anhydride form or partially esterified form on the condition that at least two free carboxylic acids remain or are available in the heat recording step. According to a twenty-third embodiment of the substantially light-insensitive thermographic recording material of the present invention, the thermosensitive element further contains glutaric acid.

Surfactants and Dispersion Agents

Surfactants and dispersants aid the dispersion of ingredients or reactants which are insoluble in the particular dispersion medium. The thermographic recording materials of the present invention may contain one or more surfactants, which may be anionic, non-ionic or cationic surfactants and/or one or more dispersants.

Other Additives

The recording material may contain in addition to the ingredients mentioned above other additives such as levelling agents e.g. BAYSILON™ MA (from BAYER AG, GERMANY).

Support

The support for the thermosensitive element according to the present invention may be transparent, translucent or opaque and is a thin flexible carrier made of transparent resin film, e.g. made of a cellulose ester, cellulose triacetate, polypropylene, polycarbonate or polyester, e.g. polyethylene terephthalate.

The support may be in sheet, ribbon or web form and subbed if need be to improve the adherence to the thereon coated thermosensitive element. It may be pigmented with a blue pigment as so-called blue-base. One or more backing layers may be provided to control physical properties such as curl and static.

Protective Layer

According to a twenty-fourth embodiment of the substantially light-insensitive thermographic recording material of the present invention, the thermosensitive element is provided with a protective layer to avoid local deformation of the thermosensitive element and to improve resistance against abrasion.

According to a twenty-fifth embodiment of the substantially light-insensitive thermographic recording material of the present invention, the thermosensitive element is provided with a protective layer comprising a binder, which may be solvent-soluble, solvent-dispersible, water-soluble or water-dispersible.

According to a twenty-sixth embodiment of the substantially light-insensitive thermographic recording material of the present invention, the thermosensitive element is provided with a protective layer comprising solvent-soluble polycarbonates as binders, as described in EP-A 614 769.

According to a twenty-seventh embodiment of the substantially light-insensitive thermographic recording material of the present invention, the thermosensitive element is provided with a protective layer comprising a water-soluble or water-dispersible binder, as coating can be performed from an aqueous composition and mixing of the protective layer with the immediate underlayer can be avoided by using a solvent-soluble or solvent-dispersible binder in the immediate underlayer. The protective layer according to the present invention may be crosslinked. Crosslinking can be achieved by using crosslinking agents such as described in WO 95/12495. Solid or liquid lubricants or combinations thereof are suitable for improving the slip characteristics of the thermographic recording materials according to the present invention.

According to a twenty-eighth embodiment of the substantially light-insensitive thermographic recording material of the present invention, the thermosensitive element is provided with a protective layer comprising a solid thermomeltable lubricant such as those described in WO 94/11199. The protective layer of the thermographic recording material according to the present invention may comprise a matting agent. According to a twenty-ninth embodiment of the substantially light-insensitive thermographic recording material of the present invention, the thermosensitive element is provided with a protective layer comprising a matting agent such as described in WO 94/11198, e.g. talc particles, and optionally protrude from the protective layer.

Backing Layer Configuration

According to a thirtieth embodiment of the substantially light-insensitive thermographic recording material, according to the present invention, the support, on the opposite side of the support to the thermosensitive element, is provided with an adhesion layer containing an intrinsically conducting polymer. The adhesion layer contains a binder e.g. a latex binder and a colloidal pigment e.g. colloidal silica.

According to a thirty-first embodiment of the substantially light-insensitive thermographic recording material, according to the present invention, the support, on the opposite side of the support to the thermosensitive element, is provided with an adhesion layer containing an intrinsically conducting polymer and the adhesion layer is provided with a backing layer optionally containing a second intrinsically conducting polymer. The backing layer contains a binder e.g. poly(vinyl alcohol), poly(methyl methacrylate) and gelatine, a pigment e.g. colloidal silica, and a matting agent e.g. silica particles or polymer particles e.g. poly(methyl methacrylate) particles.

According to a thirty-second embodiment of the substantially light-insensitive thermographic recording material, according to the present invention, the support, on the opposite side of the support to the thermosensitive element, is provided with an adhesion layer containing an intrinsically conducting polymer and the adhesion layer is provided with a backing layer optionally containing a second intrinsically conducting polymer and the intrinsically conducting polymer and/or the second intrinsically conducting polymer is a polythiophene.

According to a thirty-second embodiment of the substantially light-insensitive thermographic recording material, according to the present invention, the support, on the opposite side of the support to the thermosensitive element, is provided with an adhesion layer containing an intrinsically conducting polymer and the adhesion layer is provided with a backing layer optionally containing a second intrinsically conducting polymer and the intrinsically conducting polymer and/or the second intrinsically conducting polymer is a polythiophene, which is a polymer or copolymer of a 3,4-dialkoxythiophene in which said two alkoxy groups may be the same or different or together represent an optionally substituted oxy-alkylene-oxy bridge e.g. poly(3,4-ethylenedioxythiophene).

It is important that the pH of the dispersion for coating the outermost layer of the same side of the support as the thermosensitive element be less than 5 and substantially identical to that of the dispersion for coating the outermost layer of the side of the support opposite to that of the thermosensitive element. This results in a similar surface pH from the outermost layers on both sides of the support.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Thermographic Processing

Thermographic imaging is carried out by the image-wise application of heat either in analogue fashion by direct exposure through an image or by reflection from an image, or in digital fashion pixel by pixel either by using an infra-red heat source, for example with a Nd-YAG laser or other infra-red laser, with a substantially light-insensitive thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image sing a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Industrial Application

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated. The ingredients used in the substantially light-insensitive thermographic recording materials of the invention and comparative examples in addition to those disclosed above are given below:

Ingredients for the Backing and Adhesion Layers:

POVAL™ 103=a 98% hydrolyzed poly(vinyl alcohol) from Kuraray;

V03/140=Erkol™ V03/140, a 88% hydrolyzed poly(vinyl alcohol) from Acetex Europe;

KELZAN™S=a xanthan gum from MERCK & CO., Kelco Division, USA, which according to Technical Bulletin DB-19 is a polysaccharide containing mannose, glucose and glucuronic repeating units as a mixed potassium, sodium and calcium salt;

PE40=PERAPRET™ PE40, a 40% aqueous dispersion of polyethylene latex from BASF;

Poligen™ WE7=a 40% aqueous latex of oxidized polyethylene from BASF;

LATEX01=a 26.8% aqueous latex of a copolymer of 88% vinylidene chloride, 10% methyl acrylate and 2% itaconic acid and containing 0.13% Mersolat H;

LATEX02=a 20% aqueous poly(methyl methacrylate) latex with 100 nm particles;

LATEX03=a 30% latex of a copolymer of 88% vinylidene chloride, 10% methyl acrylate and 2% itaconic acid and 0.75% Hostapon™ T;

LATEX04=a 20% aqueous poly(methyl methacrylate) latex with 50 nm particles;

PEDOT/PSS-1=a 1.2% aqueous dispersion of poly(3,4-ethylene-oxythiophene)/poly(styrene sulphonic acid) (1:2.46 by weight) produced as described in U.S. Pat. No. 5,354,613;

PEDOT/PSS-2=homogenized PEDOT/PSS-1;

Snowtex™ O=a 20% aqueous dispersion of colloidal silica from Nissan Chemical;

Kieselsol 100F=a 30% aqueous dispersion of colloidal silica from BAYER;

UVONAC=a 10% aqueous solution of acetylated ULTRAVON W;

Mersolat™ H=a 76% aqueous paste of a sodium pentadecylsulfonate from BAYER;

ZONYL™ FSO 100=a block copolymer of polyethyleneglycol and polytetrafluoroethylene with the structure: $F(CF_2CF_2)_yCH_2CH_2O(CH_2CH_2O)_xH$, where x=0 to ca. 15 and y=1 to ca. 7 from DUPONT Hostapon™ T=a 40% concentrate of a sodium salt of N-methyl-N-2-sulfoethyl-oleylamide by HOECHST;

Arkopal NO 60=a nonylphenylpolyethylene-glycol from HOECHST;

OP80=Akypo™ OP80, an 80% concentrate of an octylphenyl-oxy-polyethyleneglycol(EO 8)acetic acid from CHEMY;

MAT01=Sunsphere™51, a 8.63% dispersion of 5:7 μm silica particles from Asahi Glass;

MAT02=a 20% aqueous dispersion of 6 μm crosslinked beads of a copolymer of 98% methyl methacrylate and 2% stearyl methacrylate and 0.4% Arkopal NO 60 produced as described in U.S. Pat. No. 4,861,812;

Ingredients for Thermosensitive Element:

the organic silver salt:

AgB=silver behenate;

binders:

BL5HP=S-LEC BL5HP, a polyvinylbutyral from Sekusui;

crosslinking agent:

VL=Desmodur™ VL, a 4,4'-diisocyanatodiphenylmethane from BAYER;

the reducing agent:

CR01=methyl gallate (from U.S. Pat. No. 3,031,329 and U.S. Pat. No. 3,107,174);

CR02=3,3,3',3'-tetramethyl-1,1'-spiro-bis-indane 5,5',6,6'-tetrol (according to U.S. Pat. Nos. 3,028,254, 3,031,329 and EP 599 369):

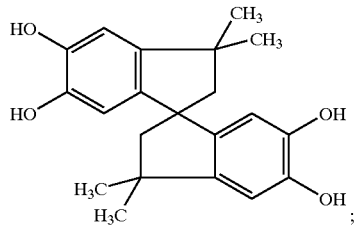

;

the toning agents:

T01=benzo[e][1,3]oxazine-2,4-dione;

T02=7-(ethylcarbonato)-benzo[e][1,3]oxazine-2,4-dione;

T03=7-methyl-benzo[e][1,3]oxazine-2,4-dione;

the stabilizers:

S01=glutaric acid;

S02=tetrachlorophthalic acid anhydride;

S03=benzotriazole.

Ingredients for the Protective Layers:

Ercol 48 20=Ercol™ 48 20, a polyvinylalcohol from Acetex Europe;

26/88=MOWIOL™ 26/88, a polyvinylalcohol from Clariant GmbH;

VP AC 4055=LEVASIL™ VP AC 4055, a 15% aqueous dispersion of colloidal silica with a specific surface area of 500 $m^2/g$ from Bayer AG which had been converted into the ammonium salt;

ULTRAVON™ W=a 75–85% concentrate of a sodium arylsulfonate from Ciba Geigy converted into acid form by passing through an ion exchange column;

SYLOID™ 72=a silica from Grace;

VPDZ 3/100=SERVOXYL™ VPDZ 3/100, a mono [isotridecyl poly-glycolether (3EO)] phosphate from Servo Delden B V);

VPAZ 100=SERVOXYL™ VPAZ 100, a mixture of monolauryl and dilauryl phosphate from Servo Delden B. V.;

type P3=MICROACE™ type P3, an Indian talc from Nippon Talc;

Satintone S=Satintone™ S, a calcined china clay from Engelhard, USA;

RILANIT™ GMS=a glycerine monotallow acid ester from Henkel AG;

TMOS=tetramethylorthosilicate hydrolyzed in the presence of methanesulfonic acid.

COMPARATIVE EXAMPLES 1 TO 12 AND INVENTION EXAMPLES 1 TO 11

Preparation of the Thermosensitive Element

The thermosensitive elements of the substantially light-insensitive thermographic recording materials of COM- PARATIVE EXAMPLES 1 to 12 and INVENTION EXAMPLES 1 to 11 were produced by coating a dispersion with the following ingredients in 2-butanone onto a subbed 168 μm thick blue-pigmented polyethylene terephthalate support with CIELAB a*- and b*-values of −7.9 and −16.6 respectively; and drying at 50° C. for 1 h in a drying cupboard to produce layers with the compositions given in Table 1.

TABLE 1

| | Reducing agent | Ratio of molar OH-equivalents to molar Ag-equivalents | AgBeh coverage [g/m²] | BL5HP [g/m²] | T01 mol % vs AgB | T02 mol % vs AgB | S01 mol % vs AgB | S02 mol % vs AgB | S03 mol % vs AgB | Oil [g/m²] |
|---|---|---|---|---|---|---|---|---|---|---|
| Comparative example nr. | | | | | | | | | | |
| 1 | CR01 | 1.0 | 3.71 | 14.84 | 15 | 5 | 24 | 4.91 | 9.84 | 0.033 |
| 2 | CR01 | 1.5 | 3.68 | 14.72 | 15 | 5 | 24 | 4.91 | 9.84 | 0.0335 |
| 3 | CR01 | 2.0 | 3.94 | 15.76 | 15 | 5 | 24 | 4.91 | 9.84 | 0.0351 |
| 4 | CR02 | 1.0 | 3.71 | 14.84 | 15 | 5 | 24 | 4.91 | 9.84 | 0.033 |
| 5 | CR02 | 1.5 | 3.63 | 14.52 | 15 | 5 | 24 | 4.91 | 9.84 | 0.0323 |
| 6 | CR02 | 2.5 | 3.63 | 14.52 | 15 | 5 | 24 | 4.91 | 9.84 | 0.0323 |
| 7 | I-6 | 1.0 | 3.81 | 15.24 | 15 | 5 | 24 | 4.91 | 9.84 | 0.0339 |
| 8 | I-6 | 1.0 | 3.50 | 14.00 | 15 | 5 | 24 | 4.91 | 9.84 | 0.0328 |
| 9 | I-6 | 7.0 | 3.50 | 14.00 | 15 | 5 | 24 | 4.91 | 9.84 | 0.0328 |
| 10 | I-13 | 1.0 | 3.45 | 13.80 | 15 | 5 | 24 | 4.91 | 9.84 | 0.0339 |
| 11 | I-13 | 7.0 | 3.60 | 14.40 | 15 | 5 | 24 | 4.91 | 9.84 | 0.0324 |
| 12 | I-14 | 1.0 | 3.58 | 14.33 | 15 | 5 | 24 | 4.91 | 9.84 | 0.0339 |
| Invention example nr | | | | | | | | | | |
| 1 | I-6 | 1.33 | 3.87 | 15.48 | 15 | 5 | 24 | 4.91 | 9.84 | 0.0344 |
| 2 | I-6 | 1.50 | 3.92 | 15.68 | 15 | 5 | 24 | 4.91 | 9.84 | 0.0349 |
| 3 | I-6 | 1.75 | 3.87 | 15.48 | 15 | 5 | 24 | 4.91 | 9.84 | 0.0344 |
| 4 | I-6 | 2.0 | 3.81 | 15.24 | 15 | 5 | 24 | 4.91 | 9.84 | 0.0339 |
| 5 | I-6 | 2.5 | 3.76 | 15.04 | 15 | 5 | 24 | 4.91 | 9.84 | 0.0335 |
| 6 | I-6 | 3.0 | 3.48 | 13.92 | 15 | 5 | 24 | 4.91 | 9.84 | 0.0335 |
| 7 | I-6 | 5.0 | 3.66 | 14.64 | 15 | 5 | 24 | 4.91 | 9.84 | 0.0332 |
| 8 | I-13 | 3.0 | 3.65 | 14.60 | 15 | 5 | 24 | 4.91 | 9.84 | 0.0337 |
| 9 | I-13 | 5.0 | 3.54 | 14.16 | 15 | 5 | 24 | 4.91 | 9.84 | 0.0325 |
| 10 | I-14 | 3.0 | 3.50 | 14.00 | 15 | 5 | 24 | 4.91 | 9.84 | 0.0349 |
| 11 | I-14 | 5.0 | 3.37 | 13.49 | 15 | 5 | 24 | 4.91 | 9.84 | 0.0344 |

Protective Layer

The thermosensitive elements of the thermographic recording materials of COMPARATIVE EXAMPLES 1 to 12 and INVENTION EXAMPLES 1 to 11 were then coated with an aqueous composition with the following ingredients to produce a layer with the following ingredient coverages as solids after drying:

ERCOL 48 20=2.1 g/m²
VP AC 4055=1.05 g/m²
ULTRAVON™ W=0.075 g/m²
SYLOID™ 72=0.09 g/m²
VPDZ 3/100=0.075 g/m²
VPAZ 100=0.075 g/m²
type P3=0.045 g/m²
RILANIT™ GMS=0.15 g/m²
TMOS (assuming complete conversion to silica)=0.87 g/m²

The pH of the coating composition was adjusted to a pH of 3.8 by adding 1N nitric acid. Those lubricants which were insoluble in water, were dispersed in a ball mill with, if necessary, the aid of a dispersion agent. The composition was coated to a wet layer thickness of 85 mm and then dried at 40° C. for 15 minutes and hardened for 7 days at 45° C. and a relative humidity of 70% thereby producing the thermographic recording materials of COMPARATIVE EXAMPLES 1 to 12 and INVENTION EXAMPLES 1 to 11.

Thermographic Printing

The thermographic recording materials of COMPARATIVE EXAMPLES 1 to 12 and INVENTION EXAMPLES 1 to 11 were printed using a DRYSTAR™ 4500 printer from AGFA-GEVAERT equipped with a thin film thermal head with resistor elements 75 μm long in the transport direction of the printer and 50 μm wide in the direction perpendicular to the transport direction to print symmetrical pixels with a resolution of 508 dpi (=200 dots/cm), adapted to operate in three modes:

| | maximum printing power* [mW/pixel] | line time [ms] | heating time [ms] |
|---|---|---|---|
| DRYSTAR ™ 4500 mode 1 | 34 | 12 | 18 |
| DRYSTAR ™ 4500 mode 2 | 36 | 7 | 10.5 |
| DRYSTAR ™ 4500 mode 3 | 43.5 | 3.5 | 5.25 |

*printing power required to attain an optical density of 3.0 with a DRYSTAR ™ TM1B film The thermal head resistors were power-modulated to produce different image densities.

The maximum densities of the images ($D_{max}$) measured through a visible filter with a MACBETH™ TR924 densitometer in the grey scale step corresponding to a data level of 64 are given in Tables 2 for COMPARATIVE EXAMPLES 1 to 12 and INVENTION EXAMPLES 1 to 11 for DRYSTAR™ 4500 printer modes 1, 2 and 3 respectively.

TABLE 2

| | Reducing agent | Ratio of molar OH-equiv to molar Ag-equiv | Printer mode 1 | | | Printer mode 2 | | | Printer mode 3 | | |
|---|---|---|---|---|---|---|---|---|---|---|---|
| | | | $D_{max}$ (vis) | $D_{min}$ (vis) | $D_{max}$/AgB coverage [m2/g] | $D_{max}$ (vis) | $D_{min}$ (vis) | $D_{max}$/AgB coverage [m2/g] | $D_{max}$ (vis) | $D_{min}$ (vis) | $D_{max}$/AgB coverage [m2/g] |
| Comparative Example nr. | | | | | | | | | | | |
| 1 | CR01 | 1.0 | 3.26 | 0.23 | 0.88 | — | — | — | 3.12 | 0.22 | 0.84 |
| 2 | CR01 | 1.5 | 3.52 | 0.23 | 0.96 | — | — | — | 3.42 | 0.22 | 0.93 |
| 3 | CR01 | 2.0 | 3.52 | 0.22 | 0.89 | — | — | — | 3.59 | 0.22 | 0.91 |
| 4 | CR02 | 1.0 | 2.48 | 0.23 | 0.67 | — | — | — | 2.46 | 0.22 | 0.66 |
| 5 | CR02 | 1.5 | 3.82 | 0.22 | 1.05 | — | — | — | 3.53 | 0.22 | 0.97 |
| 6 | CR02 | 2.0 | 3.75 | 0.22 | 1.03 | — | — | — | 3.72 | 0.22 | 1.03 |
| 7 | I-6 | 1.0 | 3.39 | 0.22 | 0.89 | — | — | — | 3.49 | 0.22 | 0.91 |
| 8 | I-6 | 1.0 | 3.02 | 0.22 | 0.86 | 3.36 | 0.22 | 0.96 | 3.46 | 0.22 | 0.99 |
| 9 | I-6 | 7.0 | 3.09 | 0.21 | 0.88 | 3.39 | 0.21 | 0.97 | 3.60 | 0.22 | 1.03 |
| 10 | I-13 | 1.0 | 3.26 | 0.22 | 0.94 | 3.53 | 0.22 | 1.02 | 3.51 | 0.22 | 1.02 |
| 11 | I-13 | 7.0 | 3.29 | 0.20 | 0.91 | 3.50 | 0.20 | 0.98 | 3.62 | 0.20 | 1.00 |
| 12 | I-14 | 1.0 | 3.30 | 0.21 | 0.92 | 3.49 | 0.21 | 0.97 | 3.52 | 0.21 | 0.98 |
| Invention Example nr. | | | | | | | | | | | |
| 1 | I-6 | 1.33 | 3.50 | 0.22 | 0.90 | — | — | — | 3.74 | 0.22 | 0.96 |
| 2 | I-6 | 1.50 | 3.45 | 0.23 | 0.88 | — | — | — | 3.77 | 0.22 | 0.96 |
| 3 | I-6 | 1.75 | 3.35 | 0.22 | 0.87 | — | — | — | 3.8 | 0.22 | 0.98 |
| 4 | I-6 | 2.0 | 3.31 | 0.22 | 0.87 | — | — | — | 3.88 | 0.22 | 1.02 |
| 5 | I-6 | 2.5 | 3.23 | 0.22 | 0.86 | — | — | — | 3.78 | 0.22 | 1.00 |
| 6 | I-6 | 3.0 | 3.19 | 0.21 | 0.92 | 3.43 | 0.22 | 0.99 | 3.69 | 0.21 | 1.06 |
| 7 | I-6 | 5.0 | 3.12 | 0.21 | 0.85 | 3.39 | 0.21 | 0.93 | 3.62 | 0.22 | 0.99 |
| 8 | I-13 | 3.0 | 3.36 | 0.21 | 0.97 | 3.55 | 0.21 | 0.97 | 3.86 | 0.21 | 1.06 |
| 9 | I-13 | 5.0 | 3.12 | 0.20 | 0.89 | 3.46 | 0.20 | 0.98 | 3.69 | 0.20 | 1.03 |
| 10 | I-14 | 3.0 | 3.28 | 0.20 | 0.94 | 3.59 | 0.20 | 1.03 | 3.91 | 0.20 | 1.12 |
| 11 | I-14 | 5.0 | 3.20 | 0.19 | 0.95 | 3.48 | 0.19 | 1.03 | 3.52 | 0.20 | 1.04 |

Image Evaluation

The image tone of fresh prints made with the substantially light-insensitive thermographic recording materials of COMPARATIVE EXAMPLES 1 to 12 and INVENTION EXAMPLES 1 to 11 using printer modes 1, 2 and 3 was assessed on the basis of the L*, a* and b* CIELAB-values. The L*, a* and b* CIELAB-values were determined by spectrophotometric measurements according to ASTM Norm E179-90 in a R(45/0) geometry with evaluation according to ASTM Norm E308-90. The b* CIELAB-values changed little between the printer modes and as a function of the ratio of molar hydroxy-equivalents to molar silver equivalents. On the other hand, the a* CIELAB-values of fresh prints of the substantially light-insensitive thermographic recording materials of COMPARATIVE EXAMPLES 1 to 12 and INVENTION EXAMPLES 1 to 11 at optical densities, D, of 1.0 and 2.0 given in Table 3 changed dramatically both with the DRYSTAR™ 4500 printer mode used and with the ratio of molar hydroxy-equivalents to molar silver equivalents.

In Table 3 a* CIELAB-values are given for D=1.0 and D=2.0 for the fresh substantially light-insensitive thermographic recording materials of COMPARATIVE EXAMPLES 1 to 12 and INVENTION EXAMPLES 1 to 11 printed in printer mode 1 and the changes in a* CIELAB-values, Δa*, on changing the printer mode from mode 1 to mode 2 and mode 1 to mode 3 respectively.

In the CIELAB-system a negative CIELAB a*-value indicates a greenish image-tone becoming greener as a* becomes more negative, a positive a*-value indicating a reddish image-tone becoming redder as a* becomes more positive. A negative CIELAB b*-value indicates a bluish tone which becomes increasingly bluer as b* becomes more negative and a positive b*-value indicates a yellowish image-tone becoming more yellow as b* becomes more positive. In terms of the visual perception of an image as a whole, the image tone of elements of the image with a density of 1.0 have a stronger effect than the image tone of elements with lower or higher optical density.

In general with the DRYSTAR™ 4500 printer in mode 1 thermographic recording materials with all the reducing agents investigated surprisingly exhibited CIELAB a*-values which very strongly decreased with increasing ratio of molar hydroxy-equivalents to molar silver-equivalents in the range 1.0 to about 3.0. Above a ratio of 3.0 the change in CIELAB a*-value was much lower.

Fresh prints obtained with the substantially light-insensitive thermographic recording materials with all the reducing agents investigated surprisingly exhibited CIELAB a*-values which strongly increased as the heating time was reduced from 18 ms in printer mode 1 to 10.5 ms in printer mode 2 to 5.25 ms in printer mode 3. This effect was surprisingly ameliorated by increasing the ratio of molar hydroxy-equivalents to molar silver-equivalents. For example in the case of substantially light-insensitive recording materials with reducing agent I-6, the shift in a* CIELAB-value in going from printer mode 1 to printer mode 3 was a prohibitive ca. +11.5 at D=1.0 for a ratio of molar hydroxy-equivalents to molar silver-equivalents of 1.0

(COMPARATIVE EXAMPLES 7 and 8) and was only −0.23 at D=1.0 for a ratio of molar hydroxy-equivalents to molar silver-equivalents of 7.0 (COMPARATIVE EXAMPLE 9).

TABLE 3

| Example nr. | Reducing agent | Ratio of molar OH-equiv. to molar Ag-equiv. | Fresh print CIELAB values for D = 1.0: mode 1 a* | a*/mode2 − a*/mode1 Δa* (2/1) | a*/mode3 − a*/mode1 Δa* (3/1) | Fresh print CIELAB values for D = 2.0: mode 1 a* | a*/mode2 − a*/mode1 Δa* (2/1) | a*/mode3 − a*/mode1 Δa* (3/1) |
|---|---|---|---|---|---|---|---|---|
| COMP 1 | CR01 | 1.0 | +4.74 | — | +10.47 | +11.45 | — | +11.07 |
| COMP 2 | CR01 | 1.5 | +1.12 | — | +11.31 | +6.36 | — | +9.32 |
| COMP 3 | CR01 | 2.0 | −0.77 | — | +7.13 | +3.88 | — | +7.51 |
| COMP 4 | CR02 | 1.0 | +27.03 | — | −1.80 | +29.54 | — | −0.96 |
| COMP 5 | CR02 | 1.5 | +1.12 | — | +18.70 | +5.78 | — | +18.52 |
| COMP 6 | CR02 | 2.0 | −1.45 | — | +8.68 | +3.45 | — | +15.03 |
| COMP 7 | I-6 | 1.0 | −2.08 | | +11.99 | +2.21 | | +11.49 |
| COMP 8 | I-6 | 1.0 | −3.05 | +2.81 | +11.29 | +1.60 | +3.34 | +11.81 |
| INV 1 | I-6 | 1.33 | −3.80 | — | +9.65 | +0.13 | — | +9.92 |
| INV 2 | I-6 | 1.50 | −4.24 | — | +8.66 | −0.51 | — | +9.59 |
| INV 3 | I-6 | 1.75 | −4.53 | — | +7.06 | −1.20 | — | +8.05 |
| INV 4 | I-6 | 2.0 | −4.67 | — | +5.93 | −1.56 | — | +7.28 |
| INV 5 | I-6 | 2.5 | −4.68 | — | +3.94 | −1.94 | — | +5.94 |
| INV 6 | I-6 | 3.0 | −4.89 | −0.16 | +2.49 | −2.08 | +0.92 | +4.95 |
| INV 7 | I-6 | 5.0 | −4.64 | −0.46 | +0.68 | −2.03 | +0.38 | +3.04 |
| COMP 9 | I-6 | 7.0 | −4.64 | −0.51 | −0.23 | −2.04 | +0.10 | +2.42 |
| COMP 10 | I-13 | 1.0 | −2.66 | +2.98 | +10.70 | +1.63 | +4.27 | +11.46 |
| INV 8 | I-13 | 3.0 | −4.21 | −0.18 | +2.24 | −1.64 | +0.75 | +4.19 |
| INV 9 | I-13 | 5.0 | −3.86 | −0.56 | +0.58 | −1.39 | +0.26 | +2.87 |
| COMP 11 | I-13 | 7.0 | −3.95 | −0.47 | +0.34 | −1.53 | +0.23 | +2.84 |
| COMP 12 | I-14 | 1.0 | −2.06 | +3.57 | +11.87 | +2.43 | +4.33 | +11.99 |
| INV 10 | I-14 | 3.0 | −4.50 | +0.15 | +3.82 | −1.46 | +1.21 | +5.26 |
| INV 11 | I-14 | 5.0 | −4.48 | −0.03 | +2.20 | −1.16 | +0.80 | +4.18 |

Such an effect is only usable for substantially light-insensitive thermographic recording materials with reducing agents which upon printing with DRYSTAR™ 4500 printer in mode 1 produce prints with acceptable image tones. Table 4 summarizes the a* and b* CIELAB values obtained with the substantially light-insensitive thermographic recording materials of COMPARATIVE EXAMPLES 1 to 12 and INVENTION EXAMPLES 1 to 11.

TABLE 4

| | Reducing agent | Ratio of molar OH-equivalents to molar Ag-equivalents | (DRYSTAR ™ 4500 printer mode 1): fresh print CIELAB values: D = 1.0 a* | D = 1.0 b* | D = 2.0 a* | D = 2.0 b* |
|---|---|---|---|---|---|---|
| Comparative Example nr. | | | | | | |
| 1 | CR01 | 1.0 | +4.74 | +4.15 | +11.45 | +7.57 |
| 2 | CR01 | 1.5 | +1.12 | +2.10 | +6.36 | +4.90 |
| 3 | CR01 | 2.0 | −0.77 | +1.01 | +3.88 | +3.82 |
| 4 | CR02 | 1.0 | +27.03 | +32.06 | +29.54 | +13.85 |
| 5 | CR02 | 1.5 | +1.12 | −5.31 | +5.78 | −0.89 |
| 6 | CR02 | 2.0 | −1.45 | −4.00 | +3.45 | −0.44 |
| 7 | I-6 | 1.0 | −2.08 | −8.65 | +2.21 | −5.44 |
| 8 | I-6 | 1.0 | −3.05 | −8.02 | +1.60 | −5.37 |
| 9 | I-6 | 7.0 | −4.64 | −5.3 | −2.04 | −4.49 |
| 10 | I-13 | 1.0 | −2.66 | −7.40 | +1.63 | −5.49 |
| 11 | I-13 | 7.0 | −3.95 | −3.34 | −1.53 | −2.37 |
| 12 | I-14 | 1.0 | −2.06 | −7.53 | +2.43 | −5.70 |
| Invention Example nr. | | | | | | |
| 1 | I-6 | 1.33 | −3.80 | −8.93 | +0.13 | −6.40 |
| 2 | I-6 | 1.50 | −4.24 | −8.73 | −0.51 | −6.70 |
| 3 | I-6 | 1.75 | −4.53 | −8.33 | −1.20 | −6.73 |
| 4 | I-6 | 2.0 | −4.67 | −8.21 | −1.56 | −6.92 |
| 5 | I-6 | 2.5 | −4.68 | −7.57 | −1.94 | −6.69 |

TABLE 4-continued

| | Reducing agent | Ratio of molar OH-equivalents to molar Ag-equivalents | fresh print CIELAB values: (DRYSTAR ™ 4500 printer mode 1): D = 1.0 a* | D = 1.0 b* | D = 2.0 a* | D = 2.0 b* |
|---|---|---|---|---|---|---|
| 6 | I-6 | 3.0 | −4.89 | −6.49 | −2.08 | −5.85 |
| 7 | I-6 | 5.0 | −4.64 | −5.71 | −2.03 | −5.14 |
| 8 | I-13 | 3.0 | −4.21 | −4.94 | −1.64 | −4.32 |
| 9 | I-13 | 5.0 | −3.86 | −3.61 | −1.39 | −2.67 |
| 10 | I-14 | 3.0 | −4.50 | −4.08 | −1.46 | −3.70 |
| 11 | I-14 | 5.0 | −4.48 | −2.50 | −1.16 | −1.70 |

Table 4 shows that substantially light-insensitive thermographic recording materials of INVENTION EXAMPLES 1 to 11 and COMPARATIVE EXAMPLES 9 and 11 with reducing agents I-6, I-13 and I-14, exhibit neutral to bluish image tones. However, this is clearly not the case for the substantially light-insensitive thermographic recording materials of COMPARATIVE EXAMPLES 1 to 6 with reducing agents CR01 and CR02, which exhibited strongly reddish image tones.

TABLE 5

| Example nr. | Reducing agent | Ratio of molar OH-equiv. to molar Ag equiv. | change in CIELAB values of fresh prints after heating for 3 d at 57° C./34% RH for: D = 1.0 mode 1 Δb* | D = 1.0 mode 2 Δb* | D = 1.0 mode 3 Δb* | D = 2.0 mode 1 Δb* | D = 2.0 mode 2 Δb* | D = 2.0 mode 3 Δb* |
|---|---|---|---|---|---|---|---|---|
| COMP 1 | CR01 | 1.0 | +7.63 | — | +10.36 | −0.38 | — | −0.45 |
| COMP 2 | CR01 | 1.5 | +7.99 | — | +8.54 | −1.51 | — | +0.76 |
| COMP 3 | CR01 | 2.0 | +8.71 | — | +7.93 | +2.45 | — | −1.51 |
| COMP 4 | CR02 | 1.0 | +11.95 | — | −3.33 | −0.04 | — | −0.78 |
| COMP 5 | CR02 | 1.5 | +35.87 | — | +30.11 | +12.97 | — | +8.42 |
| COMP 6 | CR02 | 2.0 | +24.92 | — | +27.51 | +10.32 | — | +9.51 |
| COMP 7 | I-6 | 1.0 | +6.98 | — | +10.36 | +4.77 | — | +5.23 |
| COMP 8 | I-6 | 1.0 | +7.00 | +9.97 | +10.18 | +4.16 | +4.82 | +5.29 |
| INV 1 | I-6 | 1.33 | +5.25 | — | +10.13 | +3.6 | — | +6.53 |
| INV 2 | I-6 | 1.50 | +4.3 | — | +9.33 | +3.02 | — | +6.04 |
| INV 3 | I-6 | 1.75 | +3.36 | — | +8.22 | +1.98 | — | +5.85 |
| INV 4 | I-6 | 2.0 | +3.47 | — | +8.35 | +1.83 | — | +5.99 |
| INV 5 | I-6 | 2.5 | +3.61 | — | +6.57 | +1.31 | — | +4.74 |
| INV 6 | I-6 | 3.0 | +6.35 | +6.17 | +6.41 | +2.94 | +3.42 | +4.83 |
| INV 7 | I-6 | 5.0 | +9.75 | +8.18 | +5.87 | +5.55 | +3.92 | +4.38 |
| COMP 9 | I-6 | 7.0 | +11.15 | +10.82 | +7.50 | +7.51 | +5.89 | +5.08 |
| COMP 10 | I-13 | 1.0 | +2.81 | +4.69 | +6.41 | +2.43 | +3.09 | +3.53 |
| INV 8 | I-13 | 3.0 | +2.01 | +1.23 | +2.38 | −0.05 | +0.08 | +1.70 |
| INV 9 | I-13 | 5.0 | +3.59 | +2.75 | +1.63 | +0.18 | +0.21 | +1.07 |
| COMP 11 | I-13 | 7.0 | +6.02 | +5.41 | +2.91 | +2.30 | +1.73 | +1.48 |
| COMP 12 | I-14 | 1.0 | −1.49 | +2.48 | +3.51 | −1.58 | +1.97 | +2.23 |
| INV 10 | I-14 | 3.0 | −0.42 | −0.10 | +0.77 | −0.55 | +0.19 | +0.42 |
| INV 11 | I-14 | 5.0 | +0.49 | −0.03 | +0.92 | −0.33 | −0.26 | +0.90 |

Archivability Tests

Simulated long-term archivability tests were performed by heating prints produced with the DRYSTAR™ 4500 printer in modes 1, 2 and 3 with the substantially light-insensitive thermographic recording materials of COMPARATIVE EXAMPLES 1 to 12 and INVENTION EXAMPLES 1 to 11 to heating at 57° C. in 34% relative humidity for 3 days in the dark and the CIELAB b*-values were determined for densities of 1.0 and 2.0. The changes in b* CIELAB-values for densities of 1.0 and 2.0 for printer modes 1, 2 and 3 are given in Table 5.

The present invention is demarcated with respect to the prior art by the surprising decrease in a* CIELAB-values with increasing ratio of molar hydroxy-equivalents to molar silver-equivalents together with the deterioration in archivability for a ratio of molar hydroxy-equivalents to molar silver-equivalents of 7.0, see the Δb* CIELAB-values for COMPARATIVE EXAMPLE 9 and COMPARATIVE EXAMPLE 11 compared with those for INVENTION EXAMPLES 7 and 9 respectively for printer modes 1, 2 and 3.

COMPARATIVE EXAMPLE 13 AND INVENTION EXAMPLES 12 AND 13

Preparation of the Thermosensitive Element

The thermosensitive elements of the substantially light-insensitive thermographic recording materials of COMPARATIVE EXAMPLE 13 and INVENTION EXAMPLES 12 and 13 were produced by coating a dispersion with the following ingredients in 2-butanone onto a subbed 168 μm thick blue-pigmented polyethylene terephthalate support with CIELAB a*- and b*-values of −7.9 and −16.6 respectively; and drying at 75° C. (temperature of the dry air) for 7 minutes to produce layers with the compositions given in Table 6.

TABLE 6

| | Reducing agent | Ratio of molar OH-equivalents to molar Ag-equivalents | AgBeh coverage [g/m²] | BL5HP [g/m²] | T01 mol % vs AgB | T02 mol % vs AgB | S01 mol % vs AgB | S02 mol % vs AgB | S03 mol % vs AgB | Oil [g/m²] |
|---|---|---|---|---|---|---|---|---|---|---|
| Comparative example nr. | | | | | | | | | | |
| 13 | I-1<br>I-13 | 0.6 +<br>0.4 | 4.93 | 19.71 | 15 | 5 | 22 | 4.92 | 9.80 | 0.048 |
| Invention example nr | | | | | | | | | | |
| 12 | I-1<br>I-13 | 0.8 +<br>0.50 | 4.98 | 19.92 | 15 | 5 | 22 | 4.92 | 9.80 | 0.048 |
| 13 | I-1<br>I-13 | 1.00 +<br>0.60 | 4.93 | 19.17 | 15 | 5 | 22 | 4.92 | 9.80 | 0.048 |

The thermosensitive elements of the thermographic recording materials of COMPARATIVE EXAMPLE 13 and INVENTION EXAMPLES 12 and 13 were coated with a protective layer as described for the thermographic recording materials of COMPARATIVE EXAMPLES 1 to 12 and INVENTION EXAMPLES 1 to 11 and the resulting thermographic recording materials hardened for 7 days at 45° C. thereby producing the thermographic recording materials of COMPARATIVE EXAMPLE 13 and INVENTION EXAMPLES 12 and 13.

Thermographic Evaluation

The fresh thermographic recording materials of COMPARATIVE EXAMPLE 13 and INVENTION EXAMPLES 12 and 13 were printed with DRYSTAR™ 4500 printer mode 3 and evaluated as described for the thermographic recording materials of COMPARATIVE EXAMPLES 1 to 12 and INVENTION EXAMPLES 1 to 11. The results are summarized in Table 7.

The image tone obtained with the thermographic recording material containing reducing agents I-1 and I-13 in an overall ratio of molar hydroxy-equivalents to molar silver equivalents of 1.0 (COMPARATIVE EXAMPLE 13) was reddish, as can be seen be the positive CIELAB a*-value for D=2.0, whereas the image tone of the substantially light-insensitive thermographic recording materials of INVENTION EXAMPLES 12 and 13 were close to that of a typical X-ray image with conventional silver halide radiographic film.

TABLE 7

| | | | (DRYSTAR ™ 4500 printer mode 3): | | | | | | |
|---|---|---|---|---|---|---|---|---|---|
| | Reducing agent | Ratio of molar OH-equivalents to molar Ag-equivalents | $D_{max}$ (vis) | $D_{min}$ (vis) | $D_{max}$/AgB coverage [m²/g] | fresh print CIELAB values: D = 1.0 a* | D = 1.0 b* | D = 2.0 a* | D = 2.0 b* |
| Comparative Example nr. | | | | | | | | | |
| 13 | I-1<br>I-13 | 0.60 +<br>0.40 | 3.28 | 0.23 | 0.66 | −0.36 | −7.17 | +1.81 | −6.09 |
| Invention example nr | | | | | | | | | |
| 12 | I-1<br>I-13 | 0.80 +<br>0.50 | 3.41 | 0.23 | 0.69 | −2.32 | −7.25 | −0.04 | −6.30 |
| 13 | I-1<br>I-13 | 1.00 +<br>0.60 | 3.51 | 0.23 | 0.61 | −3.10 | −7.03 | −0.88 | −5.80 |

Archivability Tests

Simulated long-term archivability tests were performed by heating prints produced with the thermographic recording materials of COMPARATIVE EXAMPLES 13 and INVENTION EXAMPLES 12 and 13 to heating at 57° C. in 34% relative humidity for 3 days in the dark and the CIELAB a*- and b*-values were determined for densities of 1.0 and 2.0 are summarized for prints produced with the DRYSTAR™ 4500 printer in mode 3 in Table 8.

The changes in image tone during the archivability tests were much smaller for the substantially light-insensitive thermographic recording materials of INVENTION EXAMPLES 12 and 13 than for the substantially light-insensitive thermographic recording materials of INVENTION EXAMPLES 1–11, but these materials had the drawback that the $D_{max}$ achieved per unit silver behenate coverage was significantly lower than for the substantially light-insensitive thermographic recording materials of INVENTION EXAMPLES 1–11.

TABLE 8

| | Reducing agent | Ratio of molar OH-equivalents to molar Ag-equivalents | Δ CIELAB values of fresh prints after heating for 3 d at 57° C./34% RH for: D = 1.0 Δa* | D = 1.0 Δb* | D = 2.0 Δa* | D = 2.0 Δb* | ΔD after heating for 3d/57° C./34% RH for: ΔD for D = 1.0 | ΔD for D = 2.0 |
|---|---|---|---|---|---|---|---|---|
| Comparative Example nr | | | | | | | | |
| 13 | I-1 I-13 | 0.60 + 0.40 | +0.17 | +0.91 | −0.65 | +1.26 | +0.17 | +0.16 |
| Invention example nr | | | | | | | | |
| 12 | I-1 I-13 | 0.80 + 0.50 | +0.33 | −0.69 | −0.24 | +0.25 | +0.16 | +0.18 |
| 13 | I-1 I-13 | 1.00 + 0.60 | +0.31 | −1.35 | −0.18 | +0.30 | +0.17 | +0.20 |

(DRYSTAR ™ 4500 printer mode 3):

COMPARATIVE EXAMPLES 14 AND 15 AND INVENTION EXAMPLES 14 AND 15

Preparation of the Thermosensitive Element

The thermosensitive elements of the substantially light-insensitive thermographic recording materials of COMPARATIVE EXAMPLES 14 and 15 and INVENTION EXAMPLES 14 and 15 were produced by coating a dispersion with the following ingredients in 2-butanone onto a subbed 168 μm non-pigmented polyethylene terephthalate support; and drying at 50° C. for 1 hour to produce with the compositions given in Table 9.

TABLE 9

| | Reducing agent | Ratio of molar OH-equivalents to molar Ag-equivalents | AgBeh coverage [g/m²] | BL5HP [g/m²] | T01 mol % vs AgB | T02 mol % vs AgB | S01 mol % vs AgB | S02 mol % vs AgB | S03 mol % vs AgB | Oil [g/m²] |
|---|---|---|---|---|---|---|---|---|---|---|
| Comparative example nr. | | | | | | | | | | |
| 14 | I-6 | 1.0 | 4.1 | 16.4 | 15 | 5 | 24 | 4.92 | 9.80 | 0.048 |
| 15 | I-6 | 1.0 | 4.0 | 16.0 | 15 | 5 | 26 | 4.92 | 9.80 | 0.048 |
| Invention example nr. | | | | | | | | | | |
| 14 | I-6 | 1.5 | 4.0 | 16.0 | 15 | 5 | 24 | 4.92 | 9.80 | 0.048 |
| 15 | I-6 | 1.5 | 4.0 | 16.0 | 15 | 5 | 26 | 4.92 | 9.80 | 0.048 |

Thermographic Printing

The fresh thermographic recording materials of COMPARATIVE EXAMPLES 14 and 15 and INVENTION EXAMPLES 14 and 15 were printed using a DRYSTAR™ 2000 printer from AGFA-GEVAERT equipped with a thin film thermal head with resistor elements 152 μm long in the transport direction of the printer and 85 μm wide in the direction perpendicular to the transport direction to print symmetrical pixels (85 μm×85 μm) with a resolution of 300 dpi (=118 dots/cm), adapted to operate in two modes:

| | maximum printing power* [mW/pixel] | line time [ms] | heating time [ms] |
|---|---|---|---|
| DRYSTAR ™ 2000 mode 1 | 104 | 12 | 21.5 |
| DRYSTAR ™ 2000 mode 2 | 104 | 7.1 | 12.7 |

*printing power required to attain an optical density of 2.8 with a DRYSTAR ™ TM1B film to take into account the use of a thin intermediate material separating the imaging layer from the thermal head During printing the printhead was separated from the imaging layer by a thin intermediate material contacted with a slipping layer of a separable 5 mm thick polyethylene terephthalate ribbon coated successively with a subbing layer, heat-resistant layer and the slipping layer (anti-friction layer) giving a ribbon with a total thickness of 6 mm. During the line time the print head received constant power. The thermal head resistors were power-modulated to produce different image densities.

The prints produced were evaluated as described for the thermographic recording materials of COMPARATIVE EXAMPLES 1 to 12 and INVENTION EXAMPLES 1 to 11. The results are summarized in Tables 10 and 11 for DRYSTAR™ 2000 printer modes 1 and 2 respectively.

TABLE 10

(DRYSTAR ™ 2000 printer mode 1):

| | Reducing agent | Ratio of molar OH-equivalents to molar Ag-equivalents | CIELAB values for fresh prints | | | | | | | |
|---|---|---|---|---|---|---|---|---|---|---|
| | | | D = 0.5 | | D = 1.0 | | D = 1.5 | | D = 2.0 | |
| | | | a* | b* | a* | b* | a* | b* | a* | b* |
| Comparative Example nr. | | | | | | | | | | |
| 14 | I-6 | 1.0 | +1.01 | −0.57 | +1.72 | −4.96 | +1.63 | −7.14 | +2.24 | −7.28 |
| 15 | I-6 | 1.0 | +0.79 | −1.89 | +1.39 | −5.36 | +1.95 | −6.79 | +1.64 | −6.72 |
| Invention example nr. | | | | | | | | | | |
| 14 | I-6 | 1.5 | +0.3 | +2.12 | −0.13 | −2.27 | −0.20 | −5.07 | −0.36 | −6.75 |
| 15 | I-6 | 1.5 | −0.1 | +0.75 | −0.77 | −3.16 | −1.49 | −5.48 | −1.28 | −6.64 |

TABLE 11

(DRYSTAR ™ 2000 printer mode 2):

| | Reducing agent | Ratio of molar OH-equivalents to molar Ag-equivalents | CIELAB values for fresh prints | | | | | | | |
|---|---|---|---|---|---|---|---|---|---|---|
| | | | D = 0.5 | | D = 1.0 | | D = 1.5 | | D = 2.0 | |
| | | | a* | b* | a* | b* | a* | b* | a* | b* |
| Comparative Example nr. | | | | | | | | | | |
| 14 | I-6 | 1.0 | +3.12 | −1.39 | +5.16 | −7.25 | +4.6 | −8.22 | +6.93 | −7.59 |
| 15 | I-6 | 1.0 | +3.33 | −3.10 | +5.11 | −7.16 | +5.69 | −8.28 | +4.21 | −8.05 |
| Invention example nr. | | | | | | | | | | |
| 14 | I-6 | 1.5 | +0.66 | −0.16 | +1.55 | −5.15 | +1.47 | −7.67 | +1.87 | −7.89 |
| 15 | I-6 | 1.5 | +0.37 | −1.13 | +0.70 | −6.03 | +0.59 | −8.19 | +1.02 | −8.03 |

A desirable image tone was obtained with the thermographic recording materials containing reducing agent I-6 upon printing with the DRYSTAR™ 2000 printer mode 1 for a ratio of molar hydroxy-equivalents to molar silver equivalents of 1.5, despite the thermographic materials having been coated on a non-pigmented support, whereas thermographic recording materials containing reducing agents I-6 upon printing with the DRYSTAR™ 2000 printer mode 2 for a ratio of molar hydroxy-equivalents to molar silver equivalents of 1.0 exhibited prohibitively reddish images as can be seen from the pronouncedly positive CIELAB a*-values.

A desirable image tone was obtained with the thermographic recording materials containing reducing agents I-6 upon printing with the DRYSTAR™ 2000 printer mode 2 for a ratio of molar hydroxy-equivalents to molar silver equivalents of 1.5, despite the thermographic materials having been coated on a non-pigmented support, whereas thermographic recording materials containing reducing agents I-6 upon printing with the DRYSTAR™ 2000 printer mode 2 for a ratio of molar hydroxy-equivalents to molar silver equivalents of 1.0 exhibited prohibitively reddish images as can be seen from the pronouncedly positive CIELAB a*-values.

Archivability Tests

Simulated long-term archivability tests were performed by heating prints produced with the thermographic recording materials of COMPARATIVE EXAMPLES 14 and 15 and INVENTION EXAMPLES 14 and 15 to heating at 45° C. in 70% relative humidity for 4 days in the dark and the CIELAB a*- and b*-values determined for densities of 0.5, 1.0 and 1.5 are summarized for prints produced with DRYSTAR™ 2000 printer mode 1 and DRYSTAR™ 2000 printer mode 2 in Tables 12 and 13 respectively.

TABLE 12

(DRYSTAR ™ 2000 printer mode 1):

| | Reducing agent | Ratio of molar OH-equivalents to molar Ag-equivalents | CIELAB values for prints after 4 d/45° C./70% RH: D = 0.5 a* | D = 0.5 b* | D = 1.0 a* | D = 1.0 b* | D = 1.5 a* | D = 1.5 b* | D = 2.0 a* | D = 2.0 b* |
|---|---|---|---|---|---|---|---|---|---|---|
| Comparative Example nr. | | | | | | | | | | |
| 14 | I-6 | 1.0 | +2.44 | +0.76 | +4.31 | −2.19 | +1.54 | −4.09 | +1.10 | −4.36 |
| 15 | I-6 | 1.0 | +2.09 | −0.47 | +3.44 | −2.42 | +1.30 | −3.60 | +0.42 | −3.73 |
| Invention example nr. | | | | | | | | | | |
| 14 | I-6 | 1.5 | +0.74 | −0.48 | +0.63 | −3.52 | −0.02 | −5.48 | −0.81 | −5.66 |
| 15 | I-6 | 1.5 | +0.22 | −1.21 | +0.16 | −3.61 | −1.56 | −5.37 | −1.36 | −5.22 |

Prints produced with DRYSTAR™ 2000 printer mode 1 with the substantially light-insensitive thermographic recording materials of INVENTION EXAMPLES 14 and 15 with a ratio of molar hydroxy-equivalents to molar silver equivalents of 1.5 exhibited marginally acceptable image tones after 4 days at 45° C. and 70% relative humidity in the dark, whereas prints produced with the substantially light-insensitive thermographic recording materials of COMPARATIVE EXAMPLES 14 and 15 with a ratio of molar hydroxy-equivalents to molar silver equivalents of 1.0 were very reddish for densities of both 0.5 and 1.0.

TABLE 13

(DRYSTAR ™ 2000 printer mode 2):

| | Reducing agent | Ratio of molar OH-equivalents to molar Ag-equivalents | CIELAB values for prints after 4 d/45° C./70% RH: D = 0.5 a* | D = 0.5 b* | D = 1.0 a* | D = 1.0 b* | D = 1.5 a* | D = 1.5 b* | D = 2.0 a* | D = 2.0 b* |
|---|---|---|---|---|---|---|---|---|---|---|
| Comparative Example nr. | | | | | | | | | | |
| 14 | I-6 | 1.0 | +5.19 | +1.97 | +5.87 | −2.80 | +4.51 | −3.93 | +5.90 | −3.67 |
| 15 | I-6 | 1.0 | +4.93 | +0.59 | +5.58 | −2.51 | +8.25 | −3.95 | +2.30 | −4.80 |
| Invention example nr. | | | | | | | | | | |
| 14 | I-6 | 1.5 | +2.71 | −0.20 | +3.22 | −4.03 | +2.07 | −5.24 | +1.31 | −5.65 |
| 15 | I-6 | 1.5 | +2.21 | −0.72 | +2.03 | −4.61 | +1.32 | −6.36 | +0.51 | −5.69 |

Prints produced with DRYSTAR™ 2000 printer mode 2 with the substantially light-insensitive thermographic recording materials of INVENTION EXAMPLES 14 and 15 with a ratio of molar hydroxy-equivalents to molar silver equivalents of 1.5 exhibited a much less reddish image tone after 4 days at 45° C. and 70% relative humidity in the dark, than those produced with the substantially light-insensitive thermographic recording materials of COMPARATIVE EXAMPLES 14 and 15 with a ratio of molar hydroxy-equivalents to molar silver equivalents of 1.0 were extremely red at all densities.

COMPARATIVE EXAMPLE 16

Preparation of the Subbed Support

The subbed support was prepared by coating a 175 μm thick blue-pigmented polyethylene terephthalate support with L*, a* and b* CIELAB-values of 86.7, −8.2 and −18.2 respectively and a density through a visible filter determined with a MacBeth™ 924 of 0.19 on both sides with a layer with an aqueous ethanol dispersion containing the following ingredients to produce the following ingredient coverages as solids after drying:

| | Coverage [mg/m$^2$] |
|---|---|
| LATEX01: | 162.2 |
| Kieselsol 100F: | 40.0 |
| Mersolat ™ H | 0.85 |
| UVONAC | 4.0 |

Coating of Backing Layer

A backing layer was then applied to one side of the subbed support with an aqueous ammoniacal N-methylpyrrolidinone dispersion containing the following ingredients to produce the following ingredient coverages as solids after drying:

| | Coverage [mg/m$^2$] |
|---|---|
| Kelzan ™ S: | 10 |
| PEDOT/PSS-1: | 15 |
| UVONAC: | 21 |
| Kieselsol 100F: | 20 |
| Perapret ™: | 10 |
| LATEX02: | 200 |
| MAT02: | 30 |

Preparation of the Thermosensitive Element

The thermosensitive elements of the substantially light-insensitive thermographic recording materials of COMPARATIVE EXAMPLE 16 was produced by coating a dispersion with the following ingredients in 2-butanone to a wet thickness of 95 μm onto the side of the subbed support opposite to that to which the backing layer had been applied, and drying at 85° C. for 5 minutes to produce a layer with the following composition:

| | Coverage [g/m$^2$] | mol % vs AgB |
|---|---|---|
| AgB: | 3.809 | 100 |
| BL5HP: | 15.202 | — |
| I-6: | 0.768 | 49.50 |
| T01: | 0.209 | 15.06 |
| T02: | 0.107 | 5.02 |
| S01: | 0.271 | 24.08 |
| S02: | 0.120 | 4.94 |
| S03: | 0.100 | 9.85 |
| Oil: | 0.025 | — |

Protective Layer

The thermosensitive elements of the thermographic recording material of COMPARATIVE EXAMPLE 16 was produced by coating an aqueous dispersion with the following ingredients onto the thermosensitive element to give a layer with the following ingredient coverages as solids after drying:

ERCOL 48 20=2.1 g/m$^2$
VP AC 4055=1.05 g/m$^2$
ULTRAVON™ W=0.075 g/m$^2$
SYLOID™ 72=0.09 g/m$^2$
VPDZ 3/100=0.075 g/m$^2$
VPAZ 100=0.075 g/m$^2$
type P3=0.045 g/m$^2$
RILANIT™ GMS=0.15 g/m$^2$
TMOS (assuming that the tetramethylorthosilicate is=0.87 g/m$^2$ completely converted to $SiO_2$ The pH of the coating composition was adjusted to a pH of 3.8 by adding 1N nitric acid. Those lubricants which were insoluble in water, were dispersed in a ball mill with, if necessary, the aid of a dispersion agent. The composition was coated to a wet layer thickness of 85 μm and then dried at 40° C. for 15 minutes and hardened for 11 days at 45° C. thereby producing the thermographic recording material of COMPARATIVE EXAMPLE 16.

Thermographic Evaluation

The fresh thermographic recording materials of COMPARATIVE EXAMPLE 16 was printed with DRYSTAR™ 4500 printer modes 1, 2 and 3 and evaluated as described for the thermographic recording materials of COMPARATIVE EXAMPLES 1 to 12 and INVENTION EXAMPLES 1 to 11. The results are summarized in Table 14.

TABLE 14

| DRYSTAR 4500 mode | Ratio of molar hydroxy-equivalents to molar silver equivalents | $D_{max}$ (vis) | $D_{min}$ (vis) | $D_{max}$/AgB coverage [m$^2$/g] | fresh print CIELAB values: D = 1.0 a* | D = 1.0 b* | D = 2.0 a* | D = 2.0 b* |
|---|---|---|---|---|---|---|---|---|
| 1 | 0.99 | 3.05 | 0.22 | 0.80 | −4.66 | −9.39 | −1.11 | −5.61 |
| 2 | 0.99 | 3.15 | 0.22 | 0.83 | −2.69 | −10.87 | 1.66 | −7.85 |
| 3 | 0.99 | 3.35 | 0.22 | 0.88 | 2.72 | −13.20 | 6.79 | −9.84 |

It is clear from the CIELAB values that, for a ratio of molar hydroxy-equivalents to molar silver equivalents of 1.0 outside the scope of the present invention, there is an undesirable shift in image tone to positive values of a* i.e. to a reddish image tone with fresh films from DRYSTAR™ 4500 Printer mode 1 to modes 2 and 3 for a density of 2.0. These very strong positive shifts in CIELAB a* values from DRYSTAR™ 4500 Printer mode 1 to modes 2 and 3 are shown in Table 15.

TABLE 15

| | Mode 1 a* | a*/mode2 − a*/mode1 Δa* (2/1) | a*/mode3 − a*/mode1 Δa* (3/1) |
|---|---|---|---|
| Fresh print CIELAB values for D = 1.0 | −4.66 | 1.97 | 7.38 |
| Fresh print CIELAB values for D = 2.0 | −1.11 | 2.77 | 7.90 |

This demonstrates the strong effect of variation of the line and heating times on CIELAB a* values in rendering the image tone increasingly red with decreasing line time and heating time.

Archivability Tests

Simulated long-term archivability tests were performed by heating prints produced with the DRYSTAR™ 4500 printer in modes 1, 2 and 3 with the substantially light-insensitive thermographic recording material of COMPARATIVE EXAMPLE 16 to heating at 57° C. in 34% relative humidity for 3 days in the dark and the CIELAB b*-values were determined for densities of 1.0 and 2.0. The changes in a* and b* CIELAB-values for densities of 1.0 and 2.0 for printer modes 1, 2 and 3 are given in Table 16.

TABLE 16

| DRYSTAR 4500 PRINTER mode | Ratio of molar hydroxy-equivalents to molar silver equivalents | Δ CIELAB values of fresh prints after heating for 3 d at 57° C./34% RH for: D = 1.0 Δa* | Δb* | D = 2.0 Δa* | Δb* | ΔD after heating for 3 d at 57° C./34% RH: ΔD for D = 1.0 | ΔD for D = 2.0 |
|---|---|---|---|---|---|---|---|
| 1 | 1.00 | 2.88 | 6.45 | −0.62 | 3.77 | 0.35 | 0.30 |
| 2 | 1.00 | 2.50 | 10.12 | −1.50 | 5.98 | 0.31 | 0.31 |
| 3 | 1.00 | −0.47 | 12.40 | −2.87 | 6.87 | 0.16 | 0.28 |

There is a considerable decrease in ΔD at D=1.0 upon changing the printer mode of a DRYSTAR™ 4500 printer from mode 1 to mode 2 and mode 3 i.e. upon decreasing the line time and heating time. There is also an strong increase in Δb* value as can be seen from Table 17.

TABLE 17

| DRYSTAR ™ 4500 Printer | change in b* CIELAB value, Δb*, of fresh prints after heating for 3d at 57° C./34% RH for: D = 1.0 | D = 2.0 |
|---|---|---|
| mode 1 | 6.45 | 3.77 |
| mode 2 | 10.12 | 5.98 |
| mode 3 | 12.40 | 6.87 |

INVENTION EXAMPLES 16 TO 18

Preparation of the Subbed Support

The subbed support was prepared by coating a 168 μm thick blue-pigmented polyethylene terephthalate support with L*, a* and b* CIELAB-values of 86.7, −8.2 and −18.2 respectively and a density through a visible filter determined with a MacBeth™ 924 of 0.19 on one side with a non-antistatic layer with an aqueous dispersion containing the following ingredients to produce the following ingredient coverages as solids after drying:

| | Coverage [mg/m²] |
|---|---|
| LATEX03: | 151 |
| Kieselsol 100F: | 35 |
| Mersolat ™ H | 0.75 |

and on the other side with an antistatic layer with an aqueous dispersion containing the following ingredients to produce the following ingredient coverages as solids after drying:

| | Coverage [mg/m²] |
|---|---|
| PEDOT/PSS-2: | 2.58 |
| LATEX03: | 147.3 |
| Sorbitol (evaporated during drying): | 24.7 |
| Kieselsol 100F: | 16.4 |
| Mersolat ™ H | 0.74 |

Preparation of Backing Layer

The backing layer of the thermographic recording materials of INVENTION EXAMPLES 16 to 18 were prepared by producing a 13.2% by weight aqueous solution of POVAL™ 103 by adding 264 g to 1736 g of cold deionized water, heating to 95° C. and maintaining this temperature for 30 minutes before cooling to room temperature. This solution was then mixed with 1067.6 g of deionized water followed by 130.7 mL of a 5% solution of OP80 with mixing, then 1978.5 g of Snowtex™ O with mixing and finally 45.85 g of MAT01 with mixing. The pH of the resulting dispersion was 4.8 and was adjusted to a pH of 3.5 with 1N nitric acid before coating to a wet thickness of 40 μm on the antistatic subbing layer of the support. The resulting layer was dried with heated air with a temperature of 140° C. with the following composition as solids after drying:

POVAL 103=2.123 g/m²
OP 80=0.053 g/m²
Snowtex™ O=3.183 g/m²
Sunsphere H51=0.032 g/m²

Preparation of the Thermosensitive Element

The thermosensitive element of the substantially light-insensitive thermographic recording materials of INVENTION EXAMPLES 16 to 18 was produced by coating a dispersion to a wet thickness of 95 μm with the following ingredients in 2-butanone onto the opposite side of the support to which the backing layer had been applied, and drying at 85° C. for 5 minutes to produce a layer with the following composition:

| | Coverage [g/m²] | mol % vs AgB |
|---|---|---|
| AgB: | 4.149 | 100 |
| BL5HP: | 16.596 | — |
| I-1: | 0.438 | 35.00 |
| I-13: | 0.894 | 45.00 |
| T03: | 0.246 | 15.06 |
| S01: | 0.294 | 24.00 |
| S02: | 0.130 | 4.91 |
| S03: | 0.109 | 9.84 |
| VL: | 0.185 | — |
| Oil: | 0.037 | — |

Coating of Protective Layer

The thermosensitive elements of the thermographic recording materials of INVENTION EXAMPLES 16 to 18 were then coated with an aqueous dispersion with the following ingredients onto the thermosensitive element with the protective layers with the ingredient coverages as solids after drying given for the thermographic recording materials for INVENTION EXAMPLES 16 to 18 in Table 18.

The pH of the coating composition was adjusted to a pH of 3.8 by adding 1N nitric acid. Those lubricants which were insoluble in water, were dispersed in a ball mill with, if necessary, the aid of a dispersion agent. The composition was coated to a wet layer thickness of 85 $\mu$m and then dried at 40° C. for 15 minutes and hardened for 7 days at 50° C. thereby producing the thermographic recording materials of INVENTION EXAMPLES 16 to 18.

TABLE 18

| | Invention Example nr 16 | Invention Example nr 17 | Invention Example nr 18 |
|---|---|---|---|
| ERCOL 48 20 [g/m$^2$] | 2.1 | 2.1 | — |
| 26/88 [g/m$^2$] | — | — | 2.1 |
| VP AC 4055 [g/m$^2$] | 1.05 | 1.05 | 1.05 |
| ULTRAVON ™ W [g/m$^2$] | 0.075 | 0.075 | 0.075 |
| SYLOID ™ 72 [g/m$^2$] | 0.09 | 0.09 | 0.09 |
| VPDZ 3/100 [g/m$^2$] | 0.075 | 0.075 | 0.075 |
| VPAZ 100 [g/m$^2$] | 0.075 | 0.075 | 0.075 |

TABLE 18-continued

| | Invention Example nr 16 | Invention Example nr 17 | Invention Example nr 18 |
|---|---|---|---|
| Satintone 5 [g/m$^2$] | — | 0.100 | 0.100 |
| type P3 [g/m$^2$] | 0.045 | — | — |
| RILANIT ™GMS [g/m$^2$] | 0.15 | 0.15 | 0.15 |
| TMOS* [g/m$^2$] | 0.87 | 0.87 | 0.87 |

*assumes that tetramethylorthosilicate is completely converted to $SiO_2$

Thermographic Evaluation

The fresh thermographic recording materials of COMPARATIVE EXAMPLE 16 was printed with DRYSTAR™ 4500 printer modes 1, 2 and 3 and evaluated as described for the thermographic recording materials of COMPARATIVE EXAMPLES 1 to 12 and INVENTION EXAMPLES 1 to 11. The results are summarized in Table 19.

TABLE 19

| Invention Example nr. | DRYSTAR 4500 Printer mode | Ratio of molar OH-equivalents to molar Ag-equivalents | $D_{max}$ (vis) | $D_{min}$ (vis) | $D_{max}$/AgB coverage [m$^2$/g] | fresh print CIELAB values: D = 1.0 a* | D = 1.0 b* | D = 2.0 a* | D = 2.0 b* |
|---|---|---|---|---|---|---|---|---|---|
| 16 | 1 | 1.6 | 3.11 | 0.22 | 0.75 | −4.76 | −3.48 | −2.04 | −1.50 |
| | 2 | 1.6 | 3.04 | 0.22 | 0.73 | −5.49 | −5.02 | −2.72 | −2.54 |
| | 3 | 1.6 | 3.02 | 0.22 | 0.73 | −5.05 | −8.26 | −2.53 | −5.65 |
| 17 | 1 | 1.6 | 3.05 | 0.22 | 0.73 | −4.77 | −4.10 | −2.02 | −1.90 |
| | 2 | 1.6 | 3.01 | 0.22 | 0.73 | −5.51 | −5.74 | −2.74 | −2.99 |
| | 3 | 1.6 | 3.02 | 0.22 | 0.73 | −4.83 | −8.85 | −2.26 | −5.95 |
| 18 | 1 | 1.6 | 3.11 | 0.22 | 0.75 | −4.72 | −3.39 | −1.95 | −1.33 |
| | 2 | 1.6 | 3.07 | 0.22 | 0.74 | −5.46 | −4.89 | −2.52 | −2.42 |
| | 3 | 1.6 | 3.05 | 0.22 | 0.73 | −4.59 | −8.26 | −1.79 | −5.75 |

It is clear from the CIELAB values that, for a ratio of molar hydroxy-equivalents to molar silver equivalents of 1.6 within the scope of the present invention, the shift in b* values from DRYSTAR™ 4500 Printer mode 1 to modes 2 and 3 are to increased negativity i.e. to desirably increased bluer image tone for densities of 1.0 and 2.0. The even smaller shifts in CIELAB a* values from DRYSTAR™ 4500 Printer mode 1 to modes 2 and 3 are shown in Table 20.

TABLE 20

| Invention Example nr. | Ratio of molar OH-equiv. to molar Ag-equiv. | Fresh print CIELAB values for D = 1.0: mode 1 a* | a*/mode2 − a*/mode1 Δa* (2/1) | a*/mode3 − a*/mode1 Δa* (3/1) | Fresh print CIELAB values for D = 2.0: mode 1 a* | a*/mode2 − a*/mode1 Δa* (2/1) | a*/mode3 − a*/mode1 Δa* (3/1) |
|---|---|---|---|---|---|---|---|
| 16 | 1.60 | −4.76 | −0.73 | −0.29 | −2.04 | −0.68 | −0.49 |
| 17 | 1.60 | −4.77 | −0.74 | −0.06 | −2.02 | −0.72 | −0.24 |
| 18 | 1.60 | −4.72 | −0.74 | 0.13 | −1.95 | −0.57 | 0.16 |

This demonstrates the advantageous effect of the present invention in surprisingly allowing the same material to be used with printers used with widely differing line and heating times without a negative effect on image tone.

Archivability Tests

Simulated long-term archivability tests were performed by heating prints produced with the DRYSTAR™ 4500 printer in modes 1, 2 and 3 with the substantially light-insensitive thermographic recording materials of INVENTION EXAMPLES 16 to 19 to heating at 57° C. in 34% relative humidity for 3 days in the dark and the CIELAB a*- and b*-values were determined for densities of 1.0 and 2.0. The changes in a* and b* CIELAB-values for densities of 1.0 and 2.0 for printer modes 1, 2 and 3 are given in Table 21.

TABLE 21

| Invention Example nr. | DRYSTAR 4500 printer mode | Ratio of molar hydroxy-equivalents to molar silver equivalents | Δ CIELAB values of fresh prints after heating for 3 d at 57° C./34% RH for: D = 1.0 Δa* | D = 1.0 Δb* | D = 2.0 Δa* | D = 2.0 Δb* | ΔD after heating for 3 d/57° C./34% RH ΔD for D = 1.0 | ΔD for D = 2.0 |
|---|---|---|---|---|---|---|---|---|
| 16 | 1 | 1.60 | −1.29 | 1.85 | −0.88 | 0.40 | 0.29 | 0.20 |
| | 2 | 1.60 | 0.11 | 1.94 | −0.43 | 0.59 | 0.31 | 0.24 |
| | 3 | 1.60 | 0.75 | 3.78 | 0.06 | 2.03 | 0.22 | 0.25 |
| 17 | 1 | 1.60 | −1.67 | 2.01 | −0.97 | 0.38 | 0.29 | 0.20 |
| | 2 | 1.60 | 0.01 | 2.18 | −0.47 | 0.57 | 0.31 | 0.24 |
| | 3 | 1.60 | 0.56 | 2.60 | −0.04 | 1.72 | 0.11 | 0.24 |
| 18 | 1 | 1.60 | −1.66 | 1.59 | −0.90 | 0.01 | 0.26 | 0.17 |
| | 2 | 1.60 | −0.27 | 1.53 | −0.60 | 0.21 | 0.29 | 0.22 |
| | 3 | 1.60 | 0.30 | 2.63 | −0.25 | 1.38 | 0.10 | 0.23 |

There is little change in a* CIELAB-value during the archivability tests whether the prints were produced using DRYSTAR™ 4500 Printer modes 1, 2 or 3. The changes in b* CIELAB-values were larger for prints produced using DRYSTAR™ 4500 Printer modes 1, 2 or 3 and increased in the order mode 1, mode 2 and mode 3, i.e. with decreasing line and heating times, as can be seen in Table 22, extracted from Table 21.

TABLE 22

| Invention Example nr. | Ratio of molar hydroxy-equivalents to molar silver equivalents | change in CIELAB values of fresh prints after heating for 3 d at 57° C./34% RH for: D = 1.0 mode 1 Δb* | D = 1.0 mode 2 Δb* | D = 1.0 mode 3 Δb* | D = 2.0 mode 1 Δb* | D = 2.0 mode 2 Δb* | D = 2.0 mode 3 Δb* |
|---|---|---|---|---|---|---|---|
| 16 | 1.60 | 1.85 | 1.94 | 3.78 | 0.40 | 0.59 | 2.03 |
| 17 | 1.60 | 2.01 | 2.18 | 2.60 | 0.38 | 0.57 | 1.72 |
| 18 | 1.60 | 1.59 | 1.53 | 2.63 | 0.01 | 0.21 | 1.38 |

However, the changes in b* CIELAB-values were acceptable even in the case of prints produced with DRYSTAR™ 4500 Printer mode 3 with the lowest line and heating times.

INVENTION EXAMPLE 19

The thermographic recording material of INVENTION EXAMPLE 19 was identical to that of INVENTION EXAMPLE 16 except that the POVAL™103 was replaced by ERKOL™ V03/140 and had the following ingredient coverages as solids after drying:

V03/140=2.123 g/m$^2$
OP 80=0.053 g/m$^2$
Snowtex™ O=3.183 g/m$^2$
Sunsphere H51=0.032 g/m$^2$

Thermographic Evaluation

The fresh thermographic recording materials of INVENTION EXAMPLE 19 was printed with DRYSTAR™ 4500 printer modes 1, 2 and 3 and evaluated as described for the thermographic recording materials of COMPARATIVE EXAMPLES 1 to 12 and INVENTION EXAMPLES 1 to 11. The results are summarized in Table 23.

It is clear from the CIELAB values that, for a ratio of molar hydroxy-equivalents to molar silver equivalents of 1.6 within the scope of the present invention, the shift in b* values from DRYSTAR™ 4500 Printer mode 1 to modes 2 and 3 are to increased negativity i.e. to desirably increased bluer image tone for densities of 1.0 and 2.0.

TABLE 23

| DRYSTAR 4500 Printer mode | Ratio of molar OH-equivalents to molar Ag-equivalents | $D_{max}$ (vis) | $D_{min}$ (vis) | $D_{max}$/AgB coverage [$m^2$/g] | fresh print CIELAB values: D = 1.0 a* | D = 1.0 b* | D = 2.0 a* | D = 2.0 b* |
|---|---|---|---|---|---|---|---|---|
| 1 | 1.6 | 3.07 | 0.22 | 0.74 | −4.66 | −3.27 | −1.93 | −0.92 |
| 2 | 1.6 | 3.02 | 0.22 | 0.73 | −5.41 | −4.87 | −2.54 | −2.20 |
| 3 | 1.6 | 3.04 | 0.22 | 0.73 | −4.44 | −8.33 | −1.83 | −5.75 |

The even smaller shifts in CIELAB a* values from DRYSTAR™ 4500 Printer mode 1 to modes 2 and 3 are shown in Table 24.

TABLE 24

| Ratio of molar OH-equiv. to molar Ag-equiv. | Fresh print CIELAB values for D = 1.0: mode 1 a* | a*/mode2 − a*/mode1 Δa*(2/1) | a*/mode3 − a*/mode1 Δa*(3/1) | Fresh print CIELAB values for D = 2.0: mode 1 a* | a*/mode2 − a*/mode1 Δa*(2/1) | a*/mode3 − a*/mode1 Δa*(3/1) |
|---|---|---|---|---|---|---|
| 1.60 | −4.66 | −0.75 | 0.22 | −1.93 | −0.61 | 0.10 |

This demonstrates the advantageous effect of the present invention in surprisingly allowing the same material to be used with printers used with widely differing line and heating times without a negative effect on image tone.

Archivability Tests

Simulated long-term archivability tests were performed by heating prints produced with the DRYSTAR™ 4500 printer in modes 1, 2 and 3 with the substantially light-insensitive thermographic recording materials of INVENTION EXAMPLE 19 to heating at 57° C. in 34% relative humidity for 3 days in the dark and the CIELAB a*- and b*-values were determined for densities of 1.0 and 2.0. The changes in a* and b* CIELAB-values for densities of 1.0 and 2.0 for printer modes 1, 2 and 3 are given in Table 25.

There was little change in a* CIELAB-value during the archivability tests whether the prints were produced using DRYSTAR™ 4500 Printer modes 1, 2 or 3.

TABLE 25

| DRYSTAR 4500 Printer mode | Ratio of molar hydroxy-equivalents to molar silver equivalents | Δ CIELAB values of fresh prints after heating for 3d at 57° C./34% RH for: D = 1.0 Δa* | D = 1.0 Δb* | D = 2.0 Δa* | D = 2.0 Δb* | ΔD afer heating for 3d/57° C./34% RH: ΔD for D = 1.0 | ΔD for D = 2.0 |
|---|---|---|---|---|---|---|---|
| 1 | 1.60 | −1.62 | 1.97 | −0.90 | 0.17 | 0.25 | 0.18 |
| 2 | 1.60 | −0.14 | 1.44 | −0.63 | 0.36 | 0.26 | 0.23 |
| 3 | 1.60 | 0.15 | 3.35 | −0.34 | 1.69 | 0.24 | 0.26 |

The changes in b* CIELAB-values were larger for prints produced using DRYSTAR™ 4500 Printer modes 1, 2 or 3 and increased in the order mode 1, mode 2 and mode 3, i.e. with decreasing line and heating times, as can be seen in Table 26, which is extracted from Table 25.

TABLE 26

| Ratio of molar hydroxy-equivalents to molar silver equivalents | change in CIELAB values of fresh prints after heating for 3d at 57° C./34% RH for D = 1.0 mode 1 Δb* | D = 1.0 mode 2 Δb* | D = 1.0 mode 3 Δb* | D = 2.0 mode 1 Δb* | D = 2.0 mode 2 Δb* | D = 2.0 mode 3 Δb* |
|---|---|---|---|---|---|---|
| 1.60 | 1.97 | 1.44 | 3.35 | 0.17 | 0.36 | 1.69 |

However, the changes in b* CIELAB-values were acceptable even in the case of prints produced with DRYSTAR™ 4500 Printer mode 3 with the lowest line and heating times.

INVENTION EXAMPLE 20

Preparation of the Subbed Support

The subbed support was prepared by coating a 175 μm thick blue-pigmented polyethylene terephthalate support with L*, a* and b* CIELAB-values of 86.7, −8.2 and −18.2 respectively and a density through a visible filter determined with a MacBeth™ 924 of 0.19 with the non-antistatic and antistatic subbing layers described for the support of INVENTION EXAMPLES 16 to 18.

Coating of Backing Layer

A backing layer was applied to the antistatic layer of the support with an aqueous dispersion containing the following ingredients to produce the following ingredient coverages as solids after drying:

| | Coverage [mg/m$^2$] |
|---|---|
| KELZAN ™ S | 10 |
| PEDT/PSS-2 | 12 |
| Zonyl ™ FSO 100 | 21 |
| Kieselsol 100F | 20 |
| Poligen ™ WE7 | 10 |
| LATEX04 | 1000 |
| MAT01 | 30 |

Preparation of the Thermosensitive Element

The thermosensitive elements of the substantially light-insensitive thermographic recording materials of INVENTION EXAMPLE 20 was produced by coating a dispersion with the following ingredients in 2-butanone onto the opposite site of the support to the backing layer, and drying at 85° C for 5 minutes to produce layers with the following composition:

| | Coverage [g/m$^2$] | mol % vs AgB |
|---|---|---|
| AgB: | 4.10 | 100 |
| BL5HP: | 16.40 | — |
| I-1: | 0.37 | 29.67 |
| I-6: | 0.81 | 48.34 |
| T02: | 0.12 | 5.00 |
| T03: | 0.26 | 15.00 |
| S01: | 0.29 | 23.98 |
| S02: | 0.13 | 4.94 |
| S03: | 0.11 | 9.85 |
| Oil: | 0.036 | — |

The thermosensitive element was coated with the same protective layer as described for COMPARATIVE EXAMPLE 16.

Thermographic Evaluation

The fresh thermographic recording materials of INVENTION EXAMPLE 20 was printed with DRYSTAR™ 4500 printer modes 1, 2 and 3 and evaluated as described for the thermographic recording materials of COMPARATIVE EXAMPLES 1 to 12 and INVENTION EXAMPLES 1 to 11. The results are summarized in Table 27.

TABLE 27

| DRYSTAR 4500 printer mode | Ratio of molar hydroxy-equivalents to molar silver equivalents | $D_{max}$ (vis) | $D_{min}$ (vis) | $D_{max}$/AgB coverage [m$^2$/g] | fresh print CIELAB values: D = 1.0 a* | D = 1.0 b* | D = 2.0 a* | D = 2.0 b* |
|---|---|---|---|---|---|---|---|---|
| 1 | 1.56 | 3.05 | 0.22 | 0.74 | −4.03 | −6.89 | −2.01 | −4.80 |
| 2 | 1.56 | 2.95 | 0.22 | 0.72 | −4.66 | −8.08 | −2.20 | −5.50 |
| 3 | 1.56 | 3.18 | 0.22 | 0.78 | −3.70 | −10.77 | −0.81 | −8.07 |

It is clear from the CIELAB values that, for a ratio of molar hydroxy-equivalents to molar silver equivalents of 1.56 within the scope of the present invention, the shift in b* values from DRYSTAR™ 4500 Printer mode 1 to modes 2 and 3 are to increased negativity i.e. to desirably increased bluer image tone for densities of 1.0 and 2.0. The even smaller shifts in CIELAB a* values from DRYSTAR™ 4500 Printer mode 1 to modes 2 and 3 are shown in Table 28.

TABLE 28

| | Mode 1 a* | a*/mode 2 − a*/mode 1 Δa* (2/1) | a*/mode 3 − a*/mode 1 Δa* (3/1) |
|---|---|---|---|
| Fresh print CIELAB values for D = 1.0 | −4.03 | −0.63 | 0.33 |
| Fresh print CIELAB values for D = 2.0 | −2.01 | −0.19 | 1.20 |

This demonstrates the advantageous effect of the present invention in surprisingly allowing the same material to be used printers used with widely differing line and heating times without a negative effect on image tone.

Archivability Tests

Simulated long-term archivability tests were performed by heating prints produced with the DRYSTAR™ 4500 printer in modes 1, 2 and 3 with the substantially light-insensitive thermographic recording material of INVENTION EXAMPLE 20 to heating at 57° C. in 34% relative humidity for 3 days in the dark and the CIELAB a*- and b*-values were determined for densities of 1.0 and 2.0. The changes in a* and b* CIELAB-values for densities of 1.0 and 2.0 for printer modes 1, 2 and 3 are given in Table 29.

The change in a* CIELAB-value for prints produced using DRYSTAR™ 4500 Printer modes 1, 2 or 3 were not insubstantial and varied with the mode used, but not in the order mode 1, mode 2 and mode 3, i.e. there was no consistent increase with decreasing line and heating times.

TABLE 29

| DRYSTAR 4500 PRINTER mode | Ratio of molar hydroxy-equivalents to molar silver equivalents | Δ CIELAB values of fresh prints after heating for 3d at 57° C./34% RH for: D = 1.0 Δa* | Δb* | D = 2.0 Δa* | Δb* | ΔD after heating for 3d at 57° C./34% RH ΔD for D = 1.0 | ΔD for D = 2.0 |
|---|---|---|---|---|---|---|---|
| 1 | 1.56 | 0.65 | 1.44 | 0.35 | −0.64 | 0.45 | 0.54 |
| 2 | 1.56 | 2.35 | 1.51 | 0.95 | 0.46 | 0.48 | 0.58 |
| 3 | 1.56 | 1.94 | 3.49 | 0.46 | 2.95 | 0.44 | 0.54 |

The change in b* CIELAB-value for prints produced using DRYSTAR™ 4500 Printer modes 1, 2 or 3 during the archivability tests increased in the order mode 1, mode 2 and mode 3, i.e. there with decreasing line and heating times, as can be seen in Table 30, which is extracted from Table 29.

TABLE 30

| DRYSTAR 4500 Printer | change in b* CIELAB value, Δb*, of fresh prints after heating for 3 d at 57° C./34% RH for: D = 1.0 | D = 2.0 |
|---|---|---|
| mode 1 | 1.44 | −0.64 |
| mode 2 | 1.51 | 0.46 |
| mode 3 | 3.49 | 2.95 |

However, the changes in b* CIELAB-values were acceptable even in the case of prints produced with DRYSTAR™ 4500 Printer mode 3 with the lowest line and heating times. Having described in detail preferred embodiments of the current invention, it will now be apparent to those skilled in the art that numerous modifications can be made therein without departing from the scope of the invention as defined in the following claims.

We claim:

1. A monosheet black and white substantially light-insensitive thermographic recording material comprising a thermosensitive element and a support, the thermosensitive element containing one or more substantially light-insensitive organic silver salts, one or more reducing agents consisting of one or more 1,2-dihydroxybenzene-compounds in thermal working relationship therewith and a binder, wherein the molar ratio of molar hydroxy-equivalents of said 1,2-dihydroxybenzene compounds to molar silver-equivalents of said substantially light-insensitive organic silver salts is between 1.2 and 6.0; said 1,2-dihydroxybenzene-compounds have a $—(CH{=}CH)_nR$ group in the 4 position wherein n is zero or an integer and R is a substituent with a Hammett $\sigma_p$ constant >0.35 and <0.95 exclusive of a carboxy-group; and the benzene ring of said 1,2-dihydroxy-compounds is optionally further substituted with an entity selected from the group consisting of an alkyl, substituted alkyl, alkenyl, aryl, heteroaryl, alkoxy, thioalkyl, aryloxy, thioaryl, thioheteroaryl, acyloxy, thioacyl, amido, sulphonamido and halogen groups, an annelated aryl ring system and an annelated heteroaryl ring system.

2. Thermographic recording material according to claim 1, wherein R in said 1,2-dihydroxybenzene-compounds is $—P({=}O)R^1R^2$, $—SO_xR^3$, —CN, $—NO_2$, $—CR^4{=}NR^5$ or $—COR^6$; $R^1$ and $R^2$ are independently an alkyl, a substituted alkyl, an aryl, a substituted aryl group, an alkoxy, a substituted alkoxy, an aryloxy, a substituted aryloxy, a hydroxy group, an amino group or a substituted amino group; $R^3$ is an alkyl, a substituted alkyl, an aryl, a substituted aryl, an amino or a substituted amino group; $R^4$ is an alkyl, a substituted alkyl, an aryl or a substituted aryl group or hydrogen; $R^5$ is an alkyl, a substituted alkyl, an aryl, a substituted aryl, a hydroxy, an alkoxy, an aryloxy, an acyl, an amino or a substituted amino group; $R^6$ is a hydrogen atom or an alkyl, a substituted alkyl, an aryl, an aryl substituted with at least one substituent having a Hammett $\sigma_m$-constant >0 and <0.85, an alkoxy, a substituted alkoxy, an aryloxy, a substituted aryloxy, a heteroaryl having a unified aromaticity index greater than 53 or a substituted heteroaryl group having a unified aromaticity index greater than 53; and x is 1, 2 or 3.

3. Thermographic recording material according to claim 1, wherein said 1,2-dihydroxybenzene-compounds are selected from the group consisting of 3,4-dihydroxybenzoate alkyl and aryl esters, 3,4-dihydroxybenzophenone, 3,4-dihydroxybenzophenone compounds in which the benzene ring without hydroxy-group substituents is substituted with at least one substituent having a $\sigma_m$-constant >0 and <0.85, 3,4-dihydroxy-acetophenone and 3,4-dihydroxybenzonitrile.

4. Thermographic recording material according to claim 1, wherein said thermosensitive element contains more than one of said 1,2-dihydroxybenzene compounds according to formula (I) and one of said 1,2-dihydroxybenzene compounds according to formula (I) is 1,2-dihydroxybenzonitrile.

5. Thermographic recording material according to claim 1, wherein said molar ratio of molar hydroxy-equivalents of said 1,2-dihydroxybenzene compounds to molar silver-equivalents of said substantially light-insensitive organic silver salts is between 1.3 and 5.0.

6. Thermographic recording material according to claim 1, wherein said thermosensitive element further comprises one or more toning agents selected from the group consisting of phthalazinone, benzo[e][1,3]oxazine-2,4-dione, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

7. Thermographic recording material according to claim 1, wherein said thermosensitive element further comprises at least one optionally substituted aliphatic polycarboxylic acid and/or anhydride thereof in a molar percentage of at least 15 with respect to all the organic silver salt(s) present and in thermal working relationship therewith.

8. Thermographic recording material according to claim 7, wherein said optionally substituted aliphatic polycarboxylic acid and/or anhydride is glutaric acid.

9. Thermographic recording material according to claim 1, wherein said one or more organic silver salts are not double salts.

10. Thermographic recording material according to claim 1, wherein said support, on the opposite side of the support to said thermosensitive element, is provided with an adhesion layer containing an intrinsically conducting polymer.

11. Thermographic recording material according to claim 10, wherein and said adhesion layer is provided with a backing layer optionally containing a second intrinsically conducting polymer.

12. Thermographic recording material according to claim 10, wherein said intrinsically conducting polymer and/or said second intrinsically conducting polymer is a polythiophene.

13. Thermographic recording material according to claim 12, wherein said polythiophene is a polymer or copolymer of a 3,4-dialkoxythiophene in which said two alkoxy groups may be the same or different or together represent an optionally substituted oxy-alkylene-oxy bridge.

14. A thermographic recording process for a monosheet black and white substantially light-insensitive thermographic recording material comprising a thermosensitive element and a support, the thermosensitive element containing one or more substantially light-insensitive organic silver salts, one or more reducing agents consisting of one or more 1,2-dihydroxybenzene-compounds in thermal working relationship therewith and a binder, characterized in that the molar ratio of molar hydroxy-equivalents of said 1,2-dihydroxybenzene compounds to molar silver-equivalents of said substantially light-insensitive organic silver salts is between 1.2 and 6.0; said 1,2-dihydroxybenzene-compounds have a $—(CH{=}CH)_nR$ group in the 4 position wherein n is zero or an integer and R is a substituent with a Hammett $\sigma_p$ constant >0.35 and <0.95 exclusive of a carboxy-group; and the benzene ring of said 1,2-dihydroxy-compounds is optionally further substituted with an entity selected from the group consisting of an alkyl, substituted alkyl, alkenyl, aryl, heteroaryl, alkoxy, thioalkyl, aryloxy, thioaryl, thioheteroaryl, acyloxy, thioacyl, amido, sulphonamido and halogen groups, an annelated aryl ring system and an annelated heteroaryl ring system, comprising the steps of: (i) providing said thermographic recording material; (ii) bringing said thermographic recording material into the proximity of a heat source; (iii) applying heat imagewise from said heat source to said thermographic-recording material; and (iv) removing said thermographic recording material from the proximity of said heat source.

15. Thermographic recording process according to claim 14, wherein R in said 1,2-dihydroxybenzene-compounds is $—P({=}O)R^1R^2$, $—SO_xR^3$, —CN, $—NO_2$, $—CR^4{=}NR^5$ or $—COR^6$; $R^1$ and $R^2$ are independently an alkyl, a substituted alkyl, an aryl, a substituted aryl group, an alkoxy, a substituted alkoxy, an aryloxy, a substituted aryloxy, a hydroxy group, an amino group or a substituted amino group; $R^3$ is an alkyl, a substituted alkyl, an aryl, a substituted aryl, an amino or a substituted amino group; $R^4$ is an alkyl, a substituted alkyl, an aryl or a substituted aryl group or hydrogen; $R^5$ is an alkyl, a substituted alkyl, an aryl, a substituted aryl, a hydroxy, an alkoxy, an aryloxy, an acyl, an amino or a substituted amino group; $R^6$ is a hydrogen atom or an alkyl, a substituted alkyl, an aryl, an aryl substituted with at least one substituent having a Hammett $\sigma_m$-constant >0 and <0.85, an alkoxy, a substituted alkoxy, an aryloxy, a substituted aryloxy, a heteroaryl having a unified aromaticity index greater than 53 or a substituted heteroaryl group having a unified aromaticity index greater than 53; and x is 1, 2 or 3.

16. Thermographic recording process according to claim 14, wherein said 1,2-dihydroxybenzene-compounds are selected from the group consisting of 3,4-dihydroxybenzoate alkyl and aryl esters, 3,4-dihydroxybenzophenone, 3,4-dihydroxybenzophenone compounds in which the benzene ring without hydroxy-group substituents is substituted with at least one substituent having a $\sigma_m$-constant >0 and <0.85, 3,4-dihydroxy-acetophenone and 3,4-dihydroxybenzonitrile.

17. Thermographic recording process according to claim 14, wherein said thermosensitive element contains more than one of said 1,2-dihydroxybenzene compounds according to formula (I) and one of said 1,2-dihydroxybenzene compounds according to formula (I) is 1,2-dihydroxybenzonitrile.

18. Thermographic recording process according to claim 14, wherein said molar ratio of molar hydroxy-equivalents of said 1,2-dihydroxybenzene compounds to molar silver-equivalents of said substantially light-insensitive organic silver salts is between 1.3 and 5.0.

19. Thermographic recording process according to claim 14, wherein said thermosensitive element further comprises one or more toning agents selected from the group consisting of phthalazinone, benzo[e][1,3]oxazine-2,4-dione, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

20. Thermographic recording process according to claim 14, wherein said thermosensitive element further comprises at least one optionally substituted aliphatic polycarboxylic acid and/or anhydride thereof in a molar percentage of at least 15 with respect to all the organic silver salt(s) present and in thermal working relationship therewith.

21. Thermographic recording process according to claim 20, wherein said optionally substituted aliphatic polycarboxylic acid and/or anhydride is glutaric acid.

22. Thermographic recording process according to claim 14, wherein said one or more organic silver salts are not double salts.

23. Thermographic recording process according to claim 14, wherein said support, on the opposite side of the support to said thermosensitive element, is provided with an adhesion layer containing an intrinsically conducting polymer.

24. Thermographic recording process according to claim 23, wherein and said adhesion layer is provided with a backing layer optionally containing a second intrinsically conducting polymer.

25. Thermographic recording process according to claim 23, wherein said intrinsically conducting polymer and/or said second intrinsically conducting polymer is a polythiophene.

26. Thermographic recording process according to claim 25, wherein said polythiophene is a polymer or copolymer of a 3,4-dialkoxythiophene in which said two alkoxy groups may be the same or different or together represent an optionally substituted oxy-alkylene-oxy bridge.

27. Thermographic recording process according to claim 14, wherein said heat source is a thin film thermal head.

28. Thermographic recording process according to claim 27, wherein said thin film thermal head operates with a heating time ≦15 ms.

* * * * *